US008621843B2

(12) United States Patent
Xu et al.

(10) Patent No.: US 8,621,843 B2
(45) Date of Patent: Jan. 7, 2014

(54) COMPOSITION AND METHOD FOR REDUCING NOX EMISSIONS FROM DIESEL ENGINES AT MINIMUM FUEL CONSUMPTION

(75) Inventors: Yi Xu, Media, PA (US); Leslie R. Wolf, Naperville, IL (US)

(73) Assignee: BP Corporation North America Inc., Houston, TX (US)

( * ) Notice: Subject to any disclaimer, the term of this patent is extended or adjusted under 35 U.S.C. 154(b) by 491 days.

(21) Appl. No.: 12/915,857

(22) Filed: Oct. 29, 2010

(65) Prior Publication Data

US 2011/0099979 A1 May 5, 2011

Related U.S. Application Data

(60) Provisional application No. 61/256,461, filed on Oct. 30, 2009.

(51) Int. Cl.
*F01N 3/00* (2006.01)

(52) U.S. Cl.
USPC ..... 60/274; 60/284; 60/286; 123/1 A; 44/322; 44/446; 44/448

(58) Field of Classification Search
USPC ..... 60/274, 284, 285, 286; 123/1 A; 44/322, 44/446, 448
See application file for complete search history.

(56) References Cited

U.S. PATENT DOCUMENTS 2,912,313 A 11/1959 Hinkamp et al.
6,023,928 A * 2/2000 Peter-Hoblyn et al. ..... 60/274
6,345,499 B1 * 2/2002 Nishimura et al. ..... 60/277
7,131,402 B2 * 11/2006 Sobotowski et al. ..... 123/1 A
7,137,379 B2 * 11/2006 Sasaki et al. ..... 123/299
7,487,663 B2 2/2009 Sobotowski et al.
7,650,747 B2 * 1/2010 Sloane ..... 60/286
8,038,742 B2 * 10/2011 Shibata ..... 44/388
8,256,281 B2 * 9/2012 Nishiumi ..... 73/114.49
2003/0052041 A1 * 3/2003 Erwin et al. ..... 208/15

FOREIGN PATENT DOCUMENTS

EP 0 467 628 1/1992
WO WO 99/32584 7/1999

OTHER PUBLICATIONS

U.S. Appl. No. 61/256,725, Kumar et al.
U.S. Appl. No. 61/256,471, Xu et al.
Nandi, The Performance of Di-Tertiary-Butyl Peroxide as Cetane Improver in Diesel Fuels, Symposium on the Impact of Clean Air Act on Fuels Production and Use, Aug. 1996, pp. 863-867.
Alriksson, Low Temperature Combustion in a Heavy Duty Diesel Engine Using High Levels of EGR, SAE Technical Papers, Apr. 3, 2006.

(Continued)

*Primary Examiner* — Binh Q Tran
(74) *Attorney, Agent, or Firm* — Kelly L. Cummings

(57) ABSTRACT

A diesel fuel composition is disclosed, as well as a method for reducing NOx emissions from a diesel engine at minimum fuel consumption wherein the diesel engine operates in a low temperature combustion mode, comprising the step of adding to the diesel engine at least one diesel fuel or blending component for a diesel fuel having a combination of a low T50 in the range of from 190° C. to 280° C., a high cetane number in the range of from 31 to 60, and an effective emissions reducing amount of a nitrogen-free cetane improver.

20 Claims, 19 Drawing Sheets

(56) References Cited

OTHER PUBLICATIONS

Chen, The Influence of DTBP on Combustion and Emission of Diesel Engine, Che Yong Fa Dong Ji, = Vehicle, CN, vol. 4, No. 183, Aug. 1, 2009, pp. 83-87, 97.

Ickes et al., Effect of 2-Ethylhexyl Nitrate Cetane Improver on $NO_x$ Emissions from Premixed Low-Temperature Diesel Combustion, Energy Fuels 2009, 23, pp. 4943-4948.

* cited by examiner

COMPOSITION AND METHOD FOR REDUCING NOX EMISSIONS FROM DIESEL ENGINES AT MINIMUM FUEL CONSUMPTION

CROSS-REFERENCE TO RELATED APPLICATION

The present application claims priority to U.S. Provisional Patent Application No. 61/256,461, filed on Oct. 30, 2009, which is incorporated herein by reference.

FIELD OF THE INVENTION

The present invention relates generally to diesel fuels and engine performance and, more particularly, to a composition and method for reducing NOx emissions from diesel engines at minimum fuel consumption.

BACKGROUND OF THE INVENTION

Fuel properties impact the performance and emissions behavior of diesel engines through their influence on the physical process associated with jet penetration, entrainment and fuel-air mixing, as well as by changes to the combustion chemistry associated with fuel chemistry, aromatics, molecular weight and additive concentrations. Continued focus on ultra-low nitrogen oxides (NOx) engine-out targets and variation of the available fuel on the world-wide market drives the need for a deeper understanding of the changes to the engine behavior caused by fuel property fluctuations.

Homogeneous charge compression ignition (HCCI) and related advanced combustion control strategies, such as partially pre-mixed charge compression ignition (PCCI), can be used to affect low temperature combustion (LTC) in compression ignition engines. These LTC modes of engine operation allow the possibility of low fuel consumption and low exhaust emissions; particularly $NO_x$ and smoke or particulate matter. The LTC mode is characterized by at least a fraction of the air-fuel mixture being a homogeneous vapor and initial heat release taking place at relatively low temperature. Operation in LTC mode has local equivalence ratios of about 0.2 to 2.0 and local temperatures of 1500 to 2100 Kelvin.

Several studies to assess the effect of diesel fuel property changes on engine-out emissions have been reported. Many of these suggest conflicting results on the directional influences of critical fuel properties on engine behavior, some of which is explained by the significant differences in NOx levels and engine operating conditions under which the data was gathered. Through experiments on a HCCI engine, Bunting, B. G., Crawford, R.; Wolf, L.; and Xu, Y. "The Relationships of Diesel Fuel Properties, Chemistry, and HCCI Engine Performance as Determined by Principal Component Analysis," SAE Paper No. 2007-01-4059, Powertrain and Fluid Systems Conference and Exhibition, Chicago, Ill., October 2007, found that indicated fuel consumption is controlled by the fuel energy content whereas ignition characteristics are influenced by cetane number and that fuel and engine characteristics must be matched to achieve optimum performance. The problem is complicated by the typically high degree of confounding between fuel properties, which make it difficult to isolate individual effects. For example, Rosenthal, M. L. Bendinsky, T., "The Effects of Fuel Properties and Chemistry on the Emissions and Heat Release of Low-Emission Heavy Duty Diesel Engines," SAE Paper No. 932800, Fuels and Lubricants Meeting and Exposition, Philadelphia Pa., October 1993, concluded that aromatic content is the primary fuel parameter driving NO and particulate matter (i.e., smoke) emissions. However, later, Ullman, T. L., Spreen, K. B., Mason, R. L., "Effects of Cetane Number of Emissions From A Prototype 1998 Heavy-Duty Diesel Engine," SAE Paper No. 950251, February 1995, reported that increasing cetane decreased all regulated emissions on a heavy-duty engine.

As illustrated by the foregoing studies, there are inherent challenges in trying to reduce NOx emissions at minimum fuel consumption by attempting to characterize fuel effects on engine behavior and the extent to which operating conditions and the combustion system may influence the relative trends. Quantifying the relative significance of fuel properties such as cetane number, distillation curves, aromatic concentration, besides others, on a wide range of diesel engines is rather difficult. While past efforts have been instrumental in providing reasonable insights into fuel effects on generally high $NO_x$ engines and HCCI systems, the available literature on advanced ultra-low NO combustion systems which do not employ HCCI combustion technology, and using ultra-low sulfur diesel (ULSD) (less than 15 ppm sulphur content) fuel, is rather limited.

Therefore, it is highly desirable to develop an effective method for reducing NOx emissions from diesel engines operating in a low temperature combustion mode at minimum fuel consumption. It would also be desirable to provide a diesel fuel composition which effectively reduces NOx emissions from diesel engines operating in a low temperature combustion mode at minimum fuel consumption.

SUMMARY OF THE INVENTION

In one embodiment, the present invention is directed to a method for reducing NOx emissions from a diesel engine at minimum fuel consumption wherein the diesel engine operates in a low temperature combustion mode, comprising the step of adding to the diesel engine at least one diesel fuel or blending component for a diesel fuel having a combination of a low T50 in the range of from 190° C. to 280° C., a high cetane number in the range of from 31 to 60, and an effective emissions reducing amount of a nitrogen-free cetane improver.

In another aspect, the present invention provides a diesel fuel composition for reducing NOx emissions from a diesel engine at minimum fuel consumption wherein the diesel engine operates in a low temperature combustion mode, comprising at least one diesel fuel or blending component for a diesel fuel having a combination of a low T50 in the range of from 190° C. to 280° C., a high cetane number in the range of from 31 to 60, and an effective emissions reducing amount of a nitrogen-free cetane improver.

The inventive method effectively reduces NOx emissions from a diesel engine operating in a low temperature combustion mode by at least 10% at minimum fuel consumption by adding the diesel fuel composition of the present invention to the diesel engine.

DETAILED DESCRIPTION OF THE INVENTION

Figure 1:
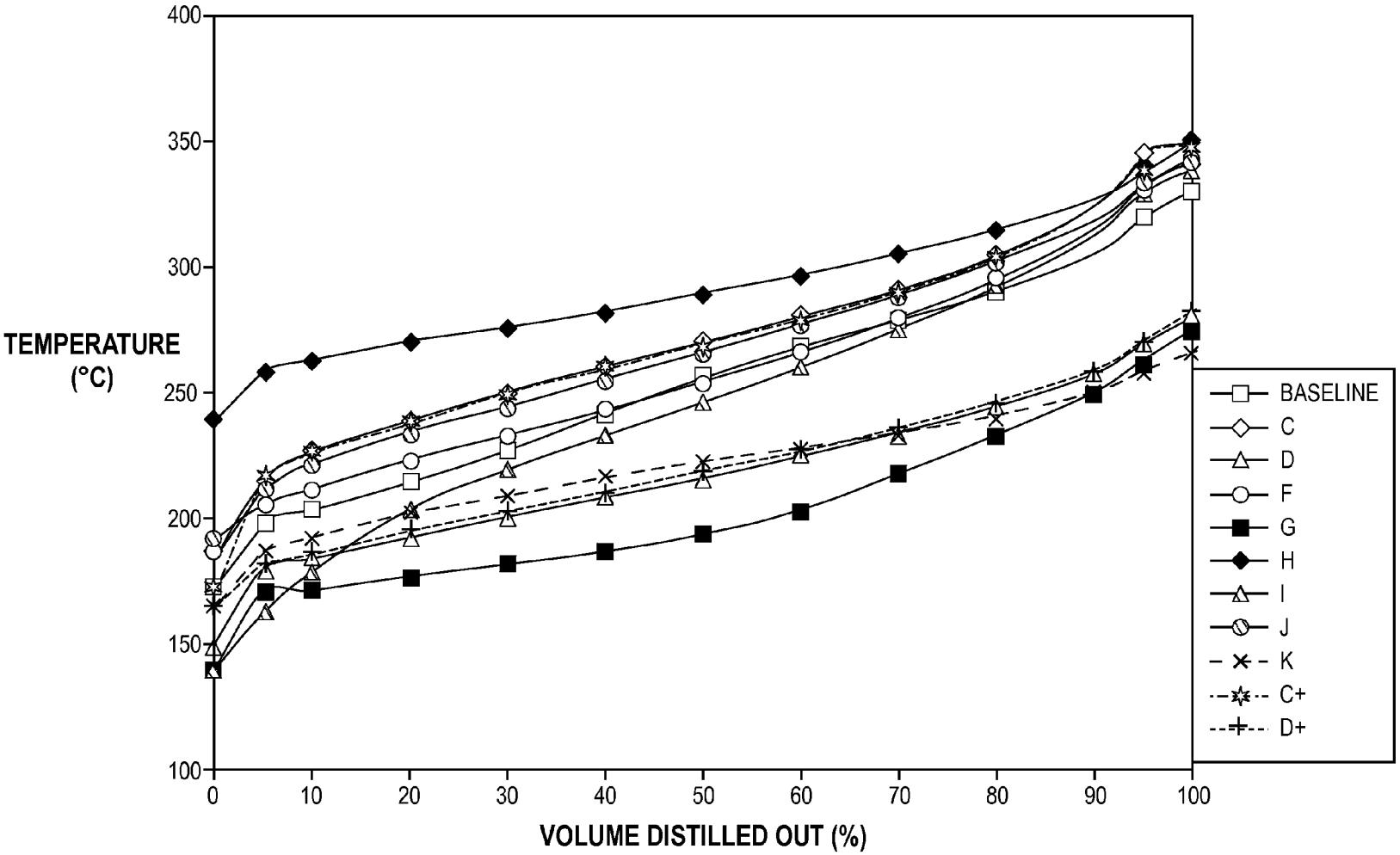
FIG. 1 contains plots of the distillation curves for the various fuels that were used to develop models for selection of an ideal fuel.
Figure 2:
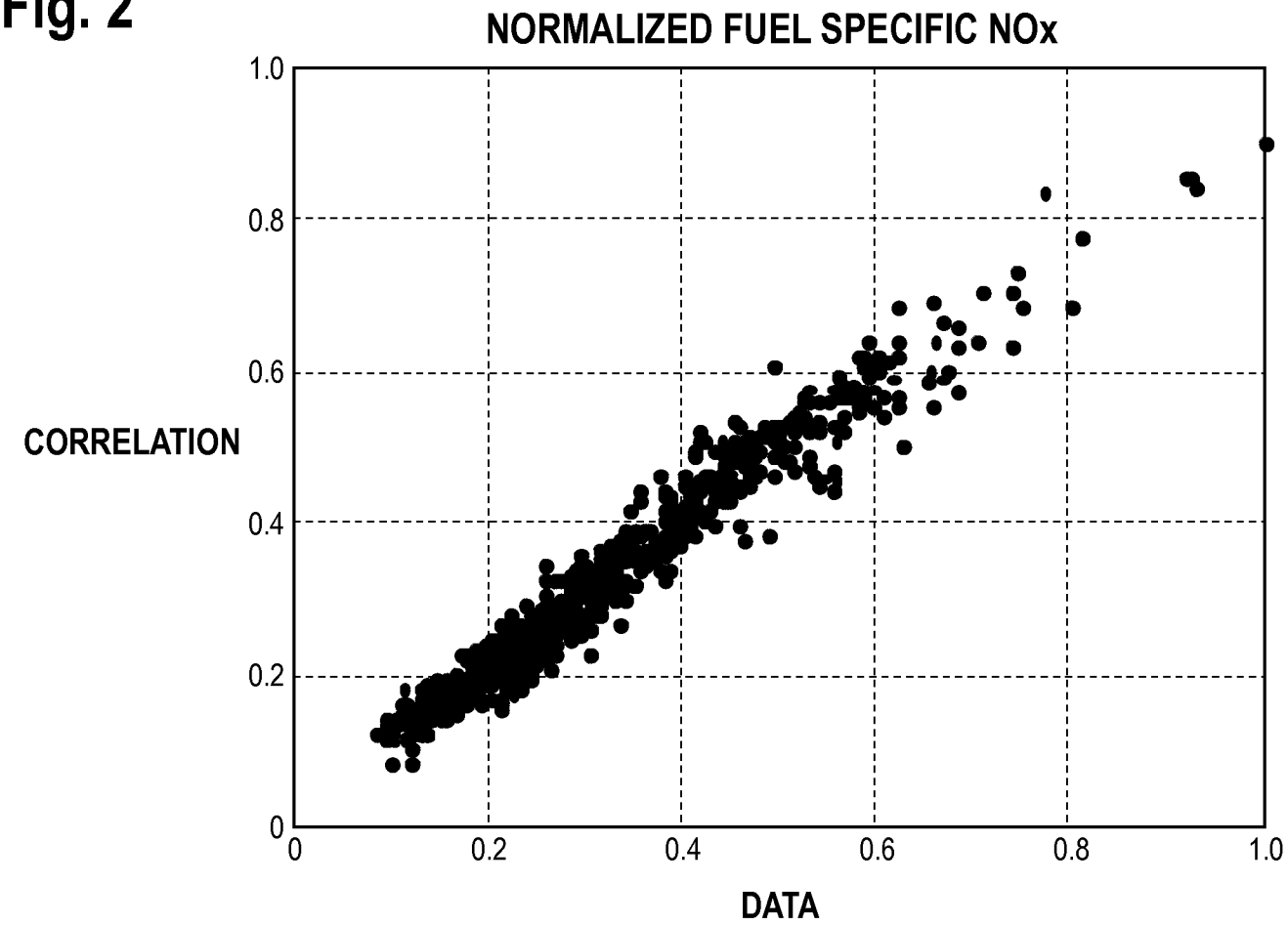
FIG. 2 is a plot of the correlations of the estimated values of the normalized fuel specific NOx versus the measured data.
Figure 3:
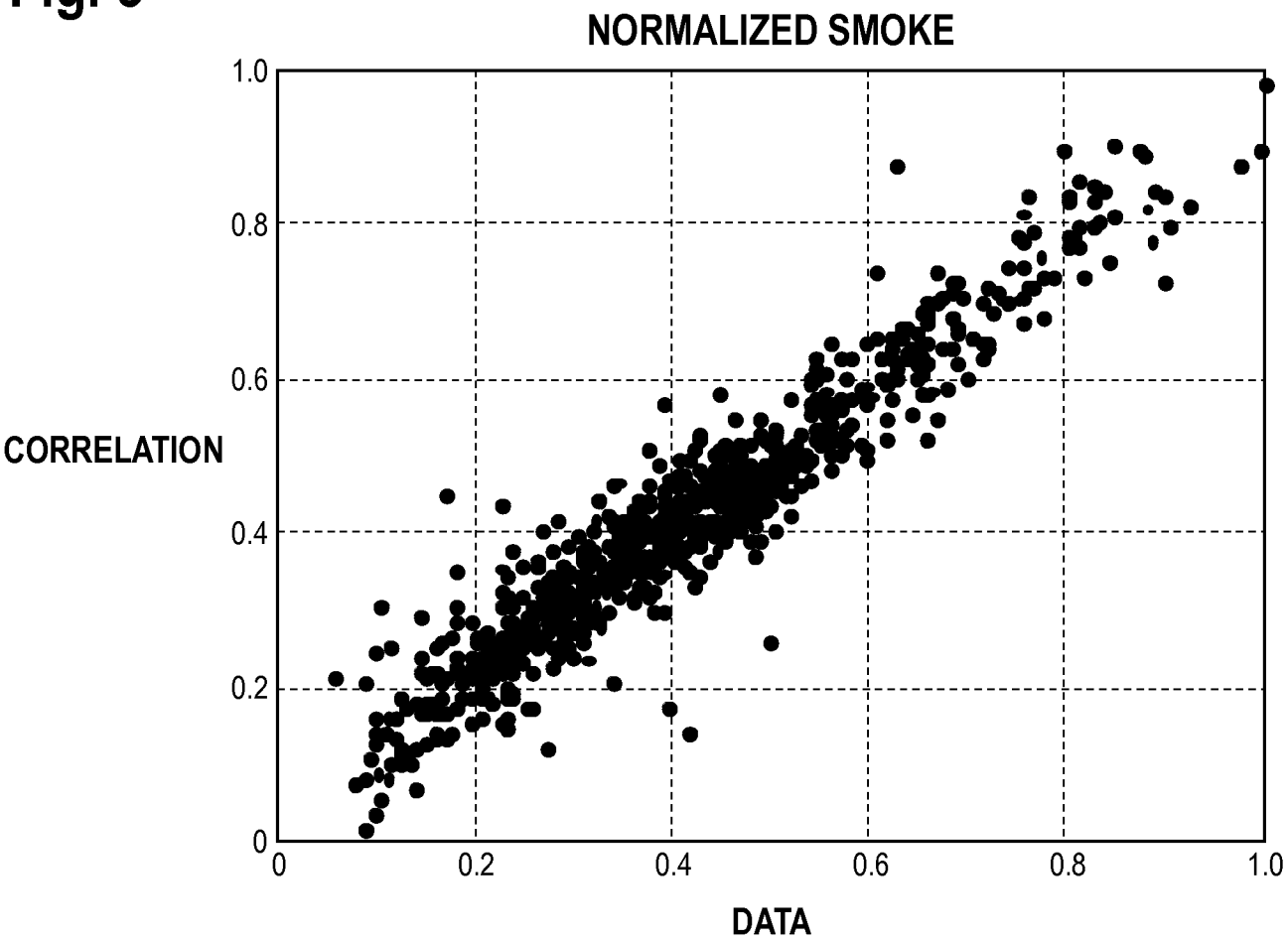
FIG. 3 is a plot of the correlations of the estimated values of the normalized smoke emissions versus the measured data.
Figure 4:
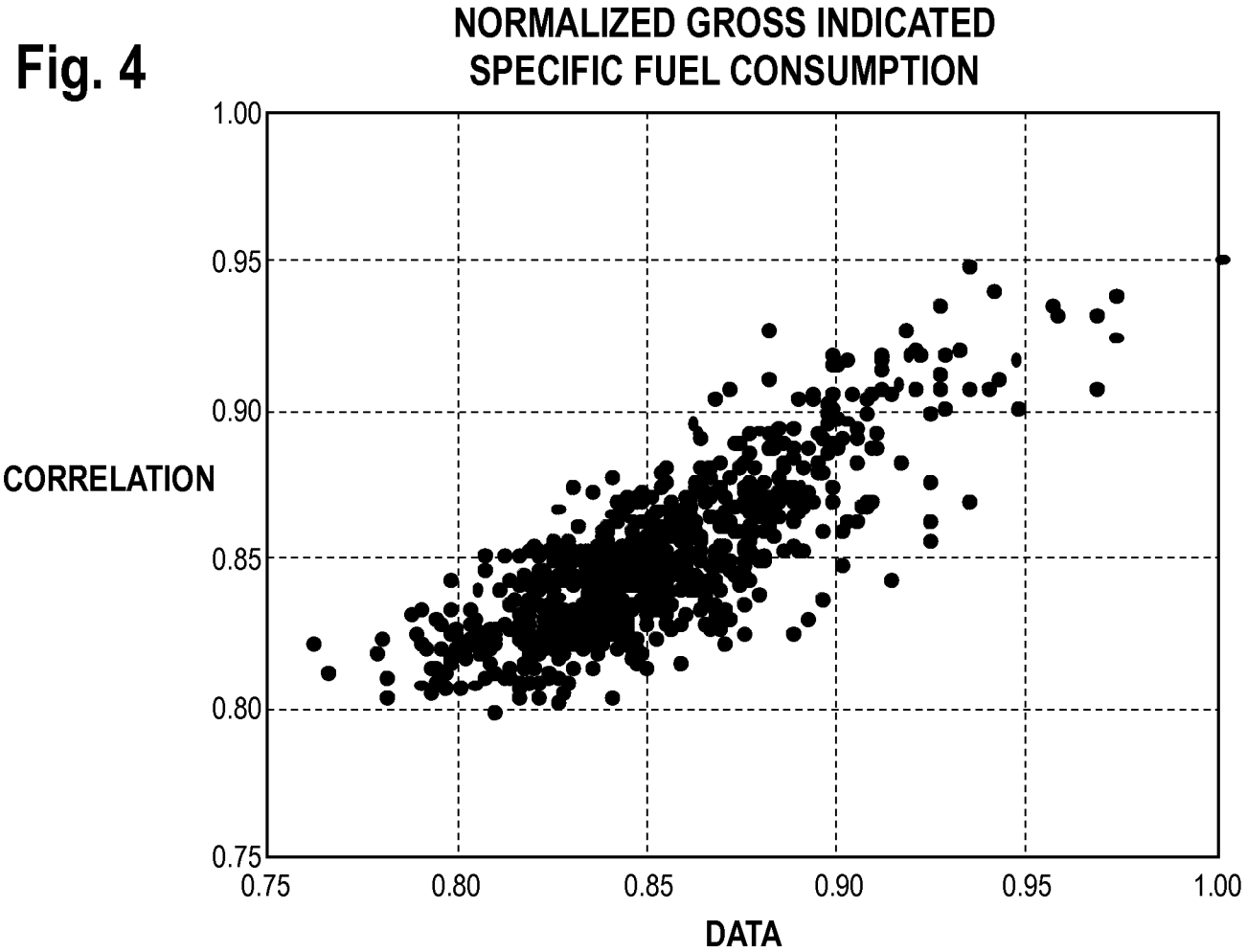
FIG. 4 is a plot of the correlations of the estimated values of the normalized gross indicated specific fuel consumption versus the measured data.
Figure 5:
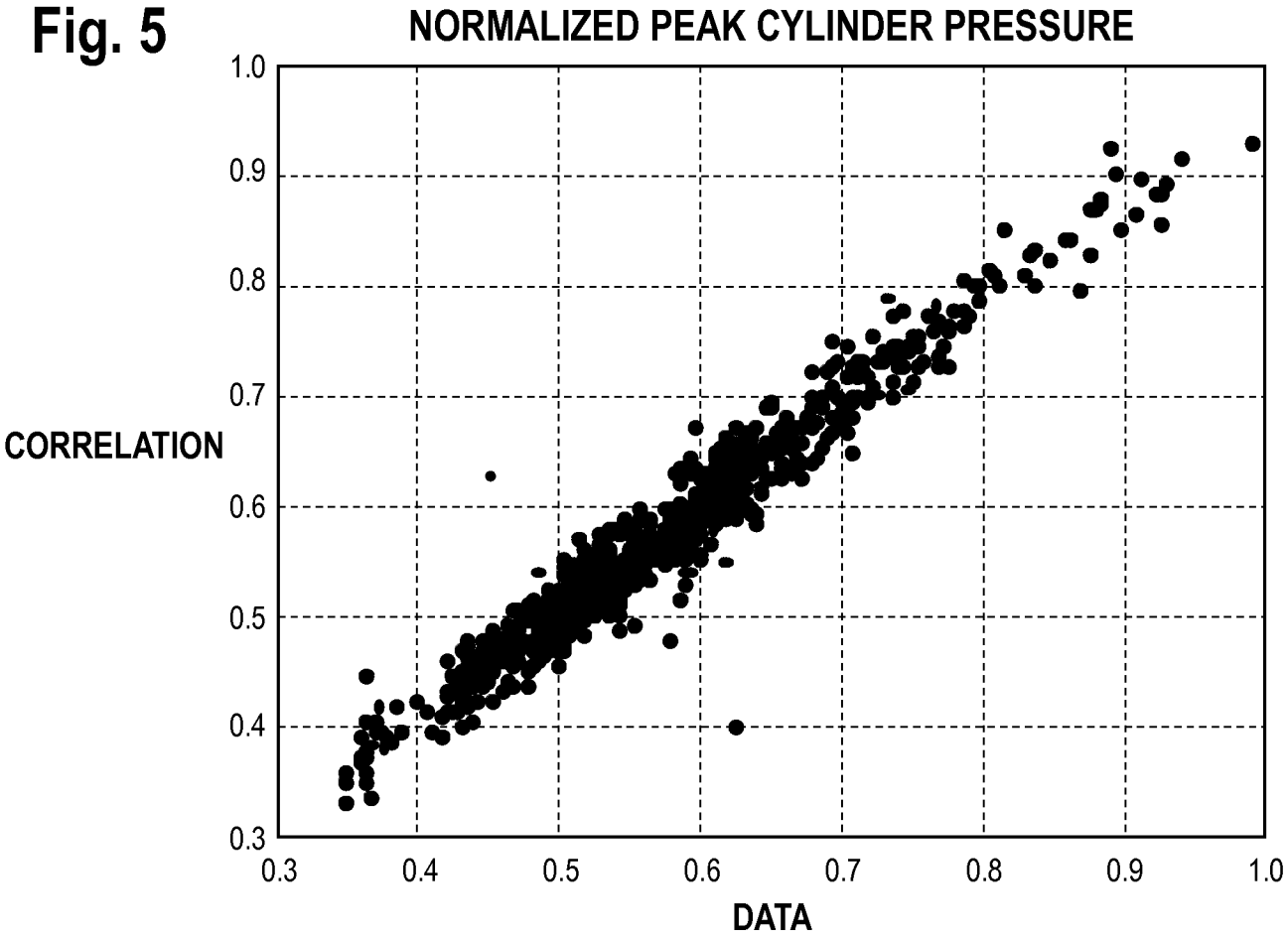
FIG. 5 is a plot of the correlations of the estimated values of the normalized peak cylinder pressure versus the measured data.
Figure 6:
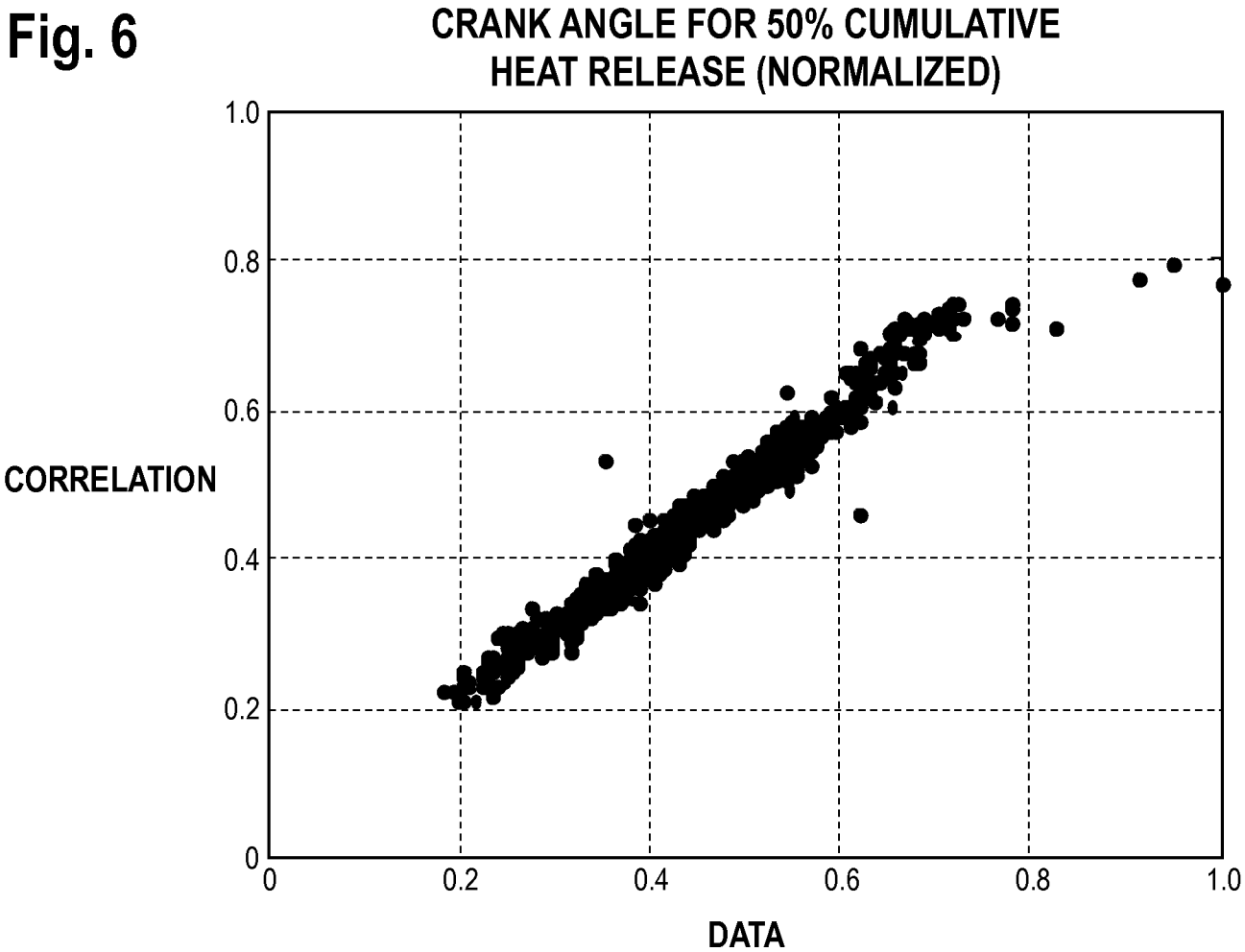
FIG. 6 is a plot of the correlations of the estimated values of the normalized crank angle for 50 percent cumulative heat release versus the measured data.
Figure 7:
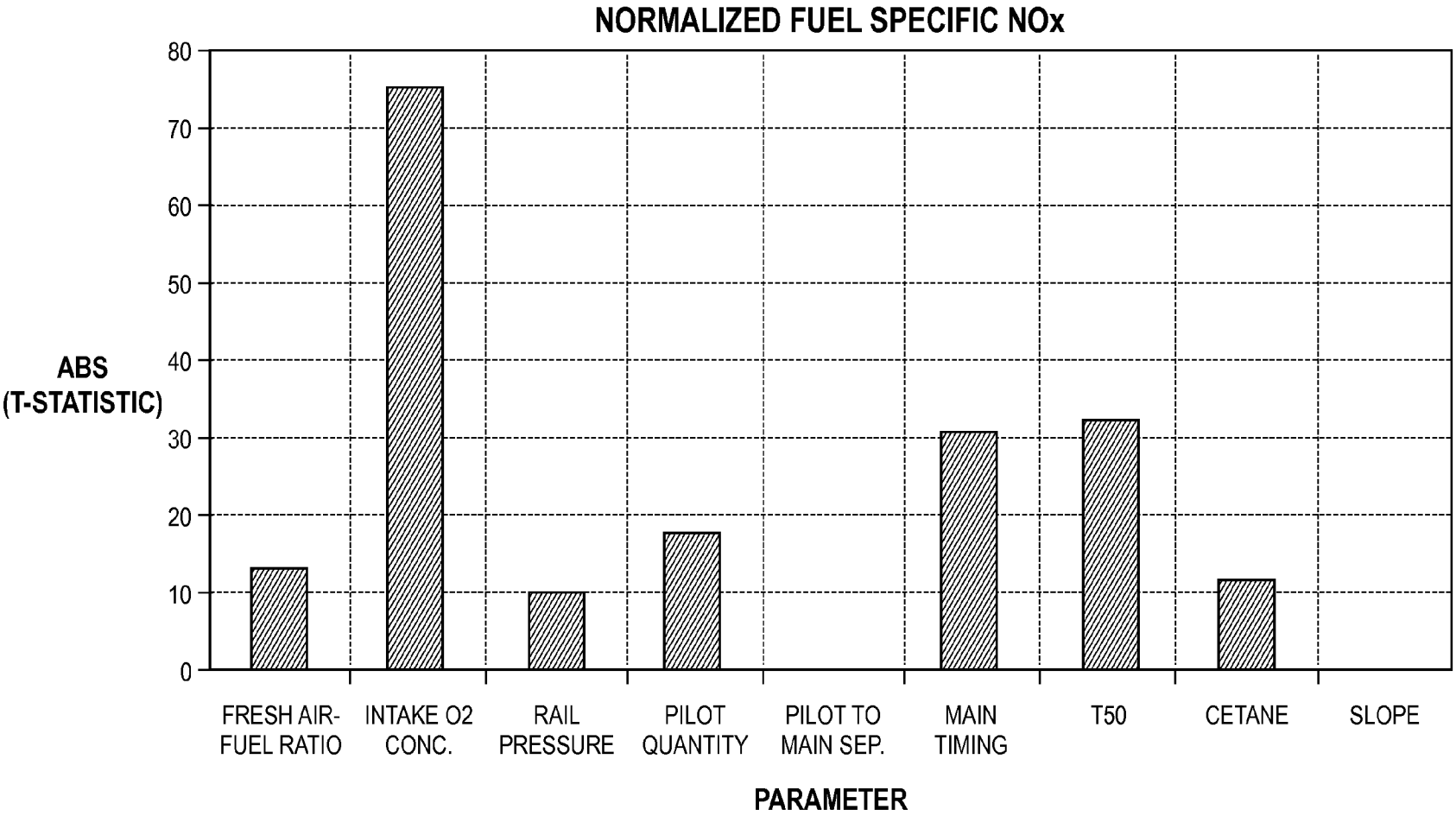
FIG. 7 is a plot of the ratio of the estimated model coefficient to the standard error for each independent engine control and fuel property with regard to its effect on the normalized fuel specific NOx emission.

In order to meet common fuel specifications such as volatility and cetane number, a refinery must blend a number of refinery stocks derived from various units in the refinery. For example, at a grossly simplified level, the primary means of modifying the boiling point curve is through the addition of polyaromatic stocks, while the primary means of modifying cetane is the addition of mono- or poly-aromatics and the use of a cetane improver.

However, fuel chemistry can be significantly altered in meeting fuel specifications. Additionally, fuel specifications are seldom changed in isolation, and the drive to meet one specification of one property may have a deleterious effect on other specified properties. Blending fuels is a complex science, and it is seldom possible to alter individual properties without also altering other properties. This makes it difficult to achieve exactly the fuels planned and results in many fuel-related properties being correlated to each other especially with a limited number of fuels. Therefore, in the present invention, as with any regression analysis the effects of individual fuel variables cannot be separated if they are highly correlated in the experimental data set.

The present invention involves the influence of diesel fuel properties on the combustion and emissions performance of diesel engines, in particular, light-duty diesel engines operating at ultra-low NO levels. Furthermore, the present invention differentiates the effect of fuel properties and engine controls, and separates out the individual contribution of fuel volatility, ignition quality and the dispersion in the distillation temperature range (which is represented by the slope, as defined below, of the distillation curve), and demonstrates that NO and smoke emissions are impacted by the mid-distillation temperature, cetane number, and cetane improver. It should also be noted that, in the practice of the present invention, emissions of unburnt hydrocarbons, particulate matter and carbon monoxide are below legislated emissions limits.

The regression-based multivariate models developed to determine the functional relationships between engine outputs and fuels and engine control levers in the present invention indicate that lower mid-distillation temperatures that were achieved by a reduction in the poly-aromatic content of the fuel provides significant reduction of $NO_x$ and smoke emissions. Increasing cetane member, which correlates with lowering mono-aromatic content, provides a small benefit of a reduction of $NO_x$ emissions. However, the use of a nitrogen-free cetane improver provides a much greater reduction of NOx emissions. There is only a small direct influence of fuel properties on gross indicated specific fuel consumption ("gisfc"), but significant indirect benefits can result from the simultaneous calibration for emissions and fuel consumption leveraging the "favorable" fuel properties. The present invention also demonstrates that the effect of fuel properties on select heat release characteristics such as peak cylinder pressure ("pcp") and on combustion phasing is not significant from the regression models. The simultaneous selection of fuel property values and engine control settings to afford the best combination of $NO_x$ emissions and fuel consumption tradeoff in the present invention indicates significant fuel consumption and $NO_x$ emission improvements to the extent of approximately 7 percent and 20 percent, respectively, from that for the baseline ULSD.

Accordingly, the present invention is directed to a new diesel fuel composition and method for reducing NOx emissions from a diesel engine at minimum fuel consumption wherein the diesel engine operates in a low temperature combustion mode. In accordance with the invention, the diesel fuel composition comprises at least one diesel fuel or blending component for a diesel fuel having a combination of a low T50 in the range of from 190° C. to 280° C., a high cetane number in the range of from 31 to 60, and an effective emissions reducing amount of a nitrogen-free cetane improver and is added to the diesel engine.

A diesel engine operates in a low temperature combustion (LTC) mode when the local combustion temperatures range between about 1500 to 2100 Kelvin and the local equivalence ratios range between about 0.2 to 2.0. In accordance with the invention, the LTC mode can be achieved by setting a value for each of the following independent engine controls for the diesel engine by (i) establishing a number of fuel property inputs, the fuel property inputs each being representative of at least one of a distillation temperature of the fuel, a cetane number of the fuel, and a distillation slope for the fuel; (ii) establishing a number of engine performance inputs, the engine performance inputs each corresponding to at least one of: fuel amount per cylinder, fuel timing, a ratio between fuel and air, a fuel pressure, a gas temperature, a gas pressure, an EGR flow, oxygen content of an engine gas flow, engine speed, and engine load; (iii) generating engine control information as a function of the fuel property inputs and the engine performance inputs; and (iv) accessing the engine control information to regulate the engine controls to afford production of a combination of the lowest NOx and smoke emissions at the lowest fuel consumption.

As used herein, "T50" is the temperature for distillation of 50 percent and is preferably in the range of from 190° C. to 255° C.

The "cetane number" as used herein may be determined in accordance with ASTM method D613 or alternative measures of ignition quality, such as a derived cetane number by ASTM D6890 or D7170. Preferably, the high cetane number will be in the range of from 40 to 60.

The nitrogen-free cetane improvers that may be used in the practice of this invention include organic compounds containing oxygen-oxygen bonds, such as alkyl peroxides, aryl peroxides, alky aryl peroxides, acyl peroxides, peroxy esters, peroxy ketones, per acids, hydroperoxides, and mixtures thereof. Specific examples of suitable nitrogen-free cetane improvers include, but are not limited to, di-tert-butyl peroxide, cumyl peroxide, 2,5-dimethyl-2,5-di(tertiary butylperoxy) hexane, tertiary butyl cumyl peroxide, benzoyl peroxide, tertiary butyl peracetate, 3,6,9-triethyl-3,9-trimethyl-1,4,7-triperoxononan, 2,2-di(teriary butyl) butane, peroxy acetic acid and tertiary butyl hydroperoxide. Di-tert-butyl peroxide is a particularly preferred nitrogen-free cetane improver.

The diesel fuel composition preferably contains an effective emissions reducing amount of the nitrogen-free cetane improver in the range of from about 10 ppm to about 10,000 ppm. More preferably, the amount of the nitrogen-free cetane improver present in the diesel fuel composition is in the range of from about 100 ppm to about 10,000 ppm.

Each diesel fuel or blending component of the present invention also optionally has a high distillation curve slope in the range of from 58° C. to 140° C., with a range of from 80° C. to 140° C. being more preferred. The slope (which is defined as the difference obtained by subtracting the temperature for distillation of 10 percent of the fuel or blending component (T10) from the temperature for distillation of 90 percent of the fuel or blending component (T90)) of the distillation curve may be determined, for example, by ASTM method D86.

The diesel fuel composition may be added to a diesel engine by any conventional method and, when added to a diesel engine operating in a LTC mode, effectively reduces NOx emissions by at least 10% at minimum fuel consumption.

In the practice of the present invention, the diesel fuel composition may also contain additives well known to those skilled in the art to enhance the fuel's handling and other performance properties. Examples of such additives include, but are not limited to, pour point depressants, wax anti-settling agents, cloud point depressants, cold flow improvers, corrosion inhibitors, antioxidants, stability enhancers, metal deactivators, lubricity improvers, detergents, dispersants, deicing agents, anti-static agents and demulsifiers.

EXAMPLES

The following examples are intended to be illustrative of the present invention and to teach one of ordinary skill how to make and use the invention. These examples are not intended to limit the invention or its protection in any way.

The method and composition of the present invention are illustrated using fuels that were blended from several intermediate refinery blend streams (i.e., blending components for a diesel fuel) and combinations of finished distillate fuels from several refineries (i.e., diesel fuels). These blends and finished fuels represent different processing methods and crude oil sources. A total of eleven different experimental diesel fuels obtained from intermediate refinery blends streams and combinations of finished distillate fuels from four refineries were used.

Variables chosen for the set of fuels employed included cetane numbers, boiling point distribution, aromatics content and cetane improver. The eleven different experimental diesel fuels obtained from intermediate refinery blends streams and combinations of finished distillate fuels from the four refineries demonstrated variations in three properties: cetane number, aromatic content and distillation temperatures. Fuels having three levels of cetane numbers of approximately 35, 45 and 55 were employed. The fuels employed had boiling point distributions that are within the ranges of either No. 1 or No. 2 diesel fuels (as required in ASTM D975 Standard Specification for Diesel Fuel Oils), with roughly three levels of T10 and two levels of T90, which represent the temperatures to achieve 10% and 90% distillation, respectively. The aromatics contents of the fuels employed were adjusted as necessary to meet cetane and boiling point values and varied from about 20% to about 50%. A cetane improver additive was employed in some cases in order to compensate for lower cetane numbers that resulted from the use of high boiling point aromatic stocks in order to modify the boiling point distributions in several of the fuels. 2-ethyl hexyl nitrate was employed as a nitrogen-containing cetane improver, and ditertiary butyl peroxide was employed as a nitrogen-free cetane improver.

The physical and chemical properties for the eleven different fuel blends used, along with the respective ASTM methods used for their measurement, are provided in Table 1.

TABLE 1

| | T10 ° C. | T50 ° C. | T90 ° C. | Cetane number | Cetane improver ppm | Mono-aromatics wt % | Poly-aromatics wt % | Total Aromatics wt % | Heating value MJ/kg |
|---|---|---|---|---|---|---|---|---|---|
| | Test Method | | | | | | | | |
| | D86 | D86 | D86 | D613 | | D5186 | D5186 | D5186 | D240 |
| Baseline | 202.2 | 255.0 | 305.0 | 44.8 | 0 | 23.28 | 9.41 | 32.69 | 45.6 |
| C | 225.6 | 268.9 | 323.3 | 35.8 | 0 | 19.69 | 33.51 | 53.2 | 44.3 |
| D | 183.9 | 215.6 | 257.8 | 46 | 0 | 16.92 | 0.98 | 17.9 | 46.0 |
| F | 210.6 | 253.9 | 315.0 | 56.9 | 200 | 18.58 | 3.88 | 22.46 | 45.9 |
| G | 170.6 | 193.3 | 250.0 | 31.5 | 0 | 43.98 | 2.31 | 46.29 | 45.0 |

TABLE 1-continued

| | T10 ° C. | T50 ° C. | T90 ° C. | Cetane number | Cetane improver ppm | Mono-aromatics wt % | Poly-aromatics wt % | Total Aromatics wt % | Heating value MJ/kg |
|---|---|---|---|---|---|---|---|---|---|
| | Test Method | | | | | | | | |
| | D86 | D86 | D86 | D613 | | D5186 | D5186 | D5186 | D240 |
| H | 262.2 | 288.3 | 326.1 | 44.4 | 0 | 18.44 | 24.11 | 42.55 | 44.7 |
| I | 178.3 | 245.6 | 312.2 | 46.9 | 0 | 16.36 | 7.42 | 23.78 | 46.0 |
| J | 221.1 | 265.0 | 318.3 | 44.6 | 0 | 22.9 | 15.53 | 38.43 | 45.0 |
| K | 191.7 | 221.7 | 249.4 | 42.2 | 0 | 20.76 | 1.27 | 22.03 | 45.8 |
| C+ | 224.4 | 268.3 | 323.9 | 44.5 | 5000 | 20.12 | 32.41 | 52.53 | 44.3 |
| D+ | 185.0 | 217.8 | 258.3 | 55.4 | 3200 | 16.95 | 0.74 | 17.69 | 46.1 |

The test fuels are labeled as baseline, C, D, F, G, H, I, J, K, C+, D+. The baseline fuel is a typical, market available, No. 2 diesel fuel or ULSD blend. The two fuels with a "plus" symbol (C+ and D+) represent the ones which contain a cetane improver in significant quantities providing a cetane number boost of almost 9 over their base blends (C and D). A cetane improver is an additive used to increase the cetane level without altering other fuel properties. Typical formulations of these additives include peroxides and nitrates. Ethyl hexyl nitrate was used as the improver in the fuels C+ and D+.

FIG. 1 plots the distillation curves for the various fuels. The baseline fuel has the distillation of a typical No. 2 diesel fuel, while fuels D and K are the regular No. 1 diesel fuel. The fuel H has a much higher T10 compared to the others, whereas fuel G with a low T10 is lighter than the typical kerosene. From the distillation plot in FIG. 1, in the region spanning the 10-90% distillate levels, the curves appear rather linear. In this study, the slope between T10 and T90, and T50 are adopted to indicate fuel volatility.

In order to relate fuel properties and engine controls to the engine responses, regression models were developed for relevant performance and emissions parameters following experiments varying engine control settings and fuel properties using a single cylinder engine. These parameters included fuel specific NOx ("fsNOx"), smoke, gross indicated fuel consumption (gisfc), peak cylinder pressure ("pcp"), exhaust manifold temperature, crank angle for 50% cumulative heat release ("CA50") and others. A regression model of the form of Equation 1 below is employed to determine the relationships between the engine response and fuel properties.

$$\text{Engine parameter[fsNOx,Smoke,or others]}=f_1(\text{engine control levers})+f_2(\text{fuel properties}) \qquad \text{Equation (1)}$$

In Equation (1), the engine response is the sum of the functions $f_1$ and $f_2$, and may include NOx content of exhaust, smoke (soot) content of exhaust, a fuel consumption measure, such as gross indicated fuel consumption (gisfc) or brake specific fuel consumption (bsfc), engine gas temperature such as exhaust temperature, an engine gas pressure such as engine differential pressure, NOx, peak cylinder pressure (pcp), exhaust manifold temperature, crank angle for 50% cumulative heat release (CA50) and/or an engine gas flow rate—to name just a few examples among others. Non-limiting examples or engine control levers or "engine controls" include one or more of: injected fuel amount, number and timing of injection stages, a ratio between air and fuel, a fuel rail pressure, an engine gas temperature, an engine gas pressure, an engine gas flow, oxygen content of intake air, engine speed, and engine load. Examples of fuel characteristics include, but are not limited to: distillation temperature of the fuel (such mid-distillation temperature, T50), a cetane number of the fuel, a distillation slope for the fuel, aromatic content of the fuel, density of the fuel, and heating value of the fuel.

The regression model of Equation (1) relates fuel properties and engine controls to the engine responses. Regression models were developed for relevant performance and emissions parameters following experiments varying engine control settings and fuel properties as further described and used to determine calibration parameters for engine control.

Calibration development of diesel engines typically involves the establishment of transfer functions of the form set forth in Equation (2) as follows:

$$\text{Engine response[NOx,Smoke,gisfc,bsfc,etc]}=f_1(\text{engine control levers}), \qquad \text{Equation (2)}$$

Depending on the engine architecture, function $f_1$ consists of individual terms for: fresh air-to-fuel ratio (AF), EGR rate, rail pressure, engine speed, main injection timing and fueling, pilot and post quantities and timings, besides other parameters governing the engine pressure differential, and flow rates through by-pass valves, as applicable. From Equation (2), the equation for NOx can be explicitly written as $$[NOx]_{N\times 1}=\begin{pmatrix} a_{11} & \dots & a_{1M} \\ \vdots & \ddots & \vdots \\ a_{N1} & \dots & a_{NM} \end{pmatrix}_{N\times M}\cdot[x_1]_{M\times 1}, \qquad (3)$$

where M depends on the number of engine actuators and their respective square and interaction terms as listed in the vector $$[x_1]_{M\times 1}=\begin{bmatrix} 1 \\ AF \\ EGR \\ Railp \\ \vdots \end{bmatrix}_{M\times 1},$$

$a_{11}$-$a_{NM}$ correspond to the fit coefficients and are generally computed using the traditional least-squares technique, and N relates to the size of the dataset used to build the model. Generally, N is a large number chosen to cover the entire operating map in order to develop high fidelity models of the form indicated in Equation (3), and much larger than M.

Similar to Equation (3) the equations for other engine responses such as smoke and bsfc are set forth in Equations (4) and (5), respectively:

$$[Smoke]_{N\times 1} = \begin{pmatrix} a_{11} & \dots & a_{1M} \\ \vdots & \ddots & \vdots \\ a_{N1} & \dots & a_{NM} \end{pmatrix}_{N\times M} \cdot [x_1]_{M\times 1}, \tag{4}$$

and $$[bsfc]_{N\times 1} = \begin{pmatrix} a_{11} & \dots & a_{1M} \\ \vdots & \ddots & \vdots \\ a_{N1} & \dots & a_{NM} \end{pmatrix}_{N\times M} \cdot [x_1]_{M\times 1} \tag{5}$$

These transfer functions are typically used to optimize for minimum fuel consumption subject to mechanical constraints and emissions targets to determine the optimal control lever settings. These optimal values represent the engine calibration and are specified in the engine control unit through models or look-up tables. In a conventional look-up table based calibration, the area under the engine torque curve is discretized into small cells each representing a specific speed-load combination, with separate tables for the individual engine actuators as listed previously.

Following either experiments or simulations involving various fuel blends consistent with market-typical fuel property variation, calibrating the engine to accommodate fuel effects involves changes to Equation (2). A set of terms representing fuel properties added to the right hand side of Equation (2) results in Equation (1) above:

$$\text{Engine response[NOx,Smoke,gisfc,bsfc,etc]} = f_1(\text{engine control levers}) + f_2(\text{fuel properties}) \tag{1}$$

As previously indicated, three selected fuel properties, cetane number, mid-distillation temperature (T50) and the distillation slope (defined as T90 minus T10, which respectively, stand for the 90% and 10% distillation temperatures); have the least correlation, signifying ignition quality, volatility and the rate of change of fuel volatility, in that order. The use of physics-based parameters adds significant flexibility to the fuels model given in Equation (1). These parameters can generally be easily ascertained through standard fuel property tests and can be incorporated into a real-time dynamic implementation to facilitate controls adaptations. A different set of fuel properties may also be chosen for the model considering their impact on the engine behavior. In this context, Equation (1) can be extended as set forth in Equation (6) as follows:

$$[NOx]_{N\times 1} = \begin{pmatrix} a_{11} & \dots & a_{1M} \\ \vdots & \ddots & \vdots \\ a_{N1} & \dots & a_{NM} \end{pmatrix}_{N\times M} \cdot [x_1]_{M\times 1} + \begin{pmatrix} b_{11} & \dots & b_{1P} \\ \vdots & \ddots & \vdots \\ b_{N1} & \dots & b_{NP} \end{pmatrix}_{N\times P} \cdot \begin{bmatrix} Fuelprop\ 1 \\ Fuelprop\ 2 \\ \vdots \\ Fuelprop\ P \end{bmatrix}_{P\times 1} \tag{6}$$

where $a_{11}$-$a_{1M}$ represent the fit coefficients corresponding to the fuel properties and P indicates the number of fuel properties used for the modeling. Equation (6) can be compactly written as Equation (7):

$$[NOx]_{N\times 1} = \begin{pmatrix} a_{11} & \dots & a_{1M} & b_{11} & \dots & b_{1P} \\ \vdots & \ddots & \vdots & & & \vdots \\ a_{N1} & \dots & a_{NM} & b_{N1} & \dots & b_{NP} \end{pmatrix}_{N\times(M+P)} \cdot \begin{bmatrix} [x_1]_{M\times 1} \\ [x_2]_{P\times 1} \end{bmatrix}_{(M+P)\times 1} \tag{7}$$

$$\text{where } [x_2]_{P\times 1} = \begin{bmatrix} Fuelprop\ 1 \\ Fuelprop\ 2 \\ \vdots \\ Fuelprop\ P \end{bmatrix}_{P\times 1}.$$

Equation (7) represents a combined model capturing the effect of engine control levers and fuel properties and can be subjected to the same optimization process to determine the optimal control liner settings hereinabove. The computational approach described here helps in the following ways: (1) it enables the determination of an "ideal" fuel, and (2) it facilitates a "fuel-flexible" diesel engine when used with the appropriate control strategies which permit real-time dynamic estimation of the relevant fuel properties and on-board adjustments to deliver the best fuel efficiency. Given the generalities used in the present approach, it is applicable across a range of engine platforms and fuel types (including biodiesel).

Typically, calibration tables for engine control are generally static in nature, being initially loaded during manufacture and updated infrequently—typically during service, overhaul or upgrade (if ever). In addition to or in lieu of calibration applications, the model of Equation (1) can be implemented to change engine performance during operation by accounting for fuel effects.

The correlation of the regression terms contained in function 1($f_1$) and function 2 ($f_2$) was examined so that only the non-correlated or least correlated variables were selected for modeling. Correlation, aliasing, or collinearity indicates a linear relationship between two variables under consideration. Correlated or collinear terms in a regression equation pose singularity problems for the intermediate matrices calculated to determine the fit coefficients (owing to the matrices not being orthogonal). A response surface method-based statistical (orthogonal) experiment for the engine control levers ensured that the terms corresponding to $f_1$ were not correlated. However, in view of the expected inter-relationships between various fuel properties, the fuel terms in $f_2$ were (1) chosen appropriately to capture either the physical property effects or the chemistry-induced changes correctly, and (2) inspected for orthogonality, and the least correlated variables were selected for modeling.

Fuel properties were correlated owing to the coupled relationships between physical features like cetane number and distillation characteristics with chemical attributes such as aromatics content. Owing to the presence of hundreds of hydrocarbon species, using merely a chemical type and molecular size to characterize a given fuel is difficult. Hence, it is essential to identify a perfectly orthogonal set of independent fuel properties to analyze fuel impact on engine behavior. Hence, the least correlated fuel properties need to be isolated and included for regression modeling.

Table 2 shows simple correlations between select fuel properties: distillation characteristics (T10, T50, T90, and slope), cetane number, mono-, poly-, and total aromatic content, density and heating value. The density and heating values track the impact of fuel chemistry on physical fuel characteristics. The numbers in the table represent the R-value, which is a quantitative measure of the degree of linear relationship between two variables, with fractions approaching +1 or −1 signifying a strong linear relationship. The variable-pairs which have absolute R-values greater than or equal to 0.6 are highlighted in the table. The three distillation temperatures (T10-90) are all correlated to one another and with the poly-aromatic content. The cetane number is correlated with the mono- and the total aromatic content. The poly-aromatic content is strongly correlated with the fuel density and heating value indicating that heavy fuels tend to have a greater fraction of poly-aromatic stocks and a lower heating value as indicated previously.

TABLE 2

| | T10 | T50 | T90 | Slope | Cetane | Mono-aromatic content | Poly-aromatic content | Total Aromatic content | Density |
|---|---|---|---|---|---|---|---|---|---|
| T50 | 0.90 | | | | | | | | |
| T90 | 0.74 | 0.94 | | | | | | | |
| Slope | -0.12 | 0.30 | 0.58 | | | | | | |
| Cetane | 0.02 | 0.14 | 0.12 | 0.15 | | | | | |
| Mono-aromatic content | -0.32 | -0.48 | -0.36 | -0.15 | -0.67 | | | | |
| Poly-aromatic content | 0.77 | 0.78 | 0.76 | 0.19 | -0.32 | -0.17 | | | |
| Total Aromatic content | 0.53 | 0.45 | 0.49 | 0.09 | -0.67 | 0.41 | 0.83 | | |
| Density | 0.80 | 0.74 | 0.69 | 0.03 | -0.41 | 0.00 | 0.97 | 0.90 | |
| Heating value | -0.67 | -0.56 | -0.54 | 0.02 | 0.59 | -0.25 | -0.90 | -0.97 | -0.96 |

Examining the properties with the least aliasing and limiting to only the physical fuel properties, the cetane, T50 and the slope do not show any significant correlation and qualify as terms in the function $f_2$ in Equation (1). Therefore, the regression model reveals the relative significance of volatility, ignition quality and the distillation temperature change on engine performance and emissions and uncovers the relative sensitivity of engines response to the cetane, T50 and slope.

A Cummins 6.7 L ISB (I-6) engine modified for single cylinder operation was heavily instrumented to enable precise control and monitoring of critical parameters and used extensively for advanced combustion studies owing to the ability to achieve precise control and measurement of the test parameters. The details of the ISB engine are listed in Table 3. The cylinder block was that of a multi-cylinder engine, but only one of the cylinders underwent combustion. The engine was run on an AVL dynamometer. The composition, temperature, humidity and mass flow rate of the fresh air were carefully controlled. The intake fresh air was conditioned and its flow regulated through high-precision control valves prior to being mixed with the cooled exhaust gas recirculation ("EGR") stream. An electronically controlled high pressure Bosch common rail system provided the fuel injection. Almost independent control of EGR, mass flow rate, pressure difference across the engine and the fresh airflow was accomplished by the use of two surge tanks—one each for the intake and the exhaust side. The intake manifold temperature was controlled by means of electric heating elements located upstream of the intake surge tank. The rate of EGR was measured real time by means of a wide-band oxygen sensor (made by ECM) installed near the engine intake manifold, and controlled by actuating the EGR flow control valve. The coolant and lubricating systems were external to the engine and maintained temperatures, pressures and flow rates consistent with realistic multi-cylinder engine operation. Each fuel was thoroughly stirred prior to the commencement of the test and was pumped into the engine fuel tank from a barrel through an external lift pump. The engine system was also completely purged before the start of a new fuel test.

TABLE 3

| | |
|---|---|
| Bore | 107 mm |
| Stroke | 124 mm |
| Displacement | 1.1 L/cyl |
| Compression ratio | 17.1 |
| Swirl | 2.5 DCS |

TABLE 3-continued

| | |
|---|---|
| Fuel system | Bosch CRIN3.0 high pressure common rail |
| Injector specifications | 8 holes, 146 included angle, 550 cc/30 sec (at 100 bar) nozzle flow rate |

The fresh air mass flow rate was measured by means of a MicroMotion ELITE model coriolis flow meter. Fuel flow rate was calculated using a load-cell based balance system. The in-cylinder combustion processes were studied through the use of a high-precision KISTLER water-cooled pressure transducer and recorded and analyzed. Gaseous emissions were measured on both the intake and exhaust side using a multi-function bench made by California Analytical Instruments. Measurements for the exhaust-side NOx, CO, $O_2$, and unburnt hydrocarbon ("UHC") species were made using appropriate analyzers, and an AVL415 was used to record smoke data. Carbon-dioxide was logged on both the intake and exhaust gas streams of the engine through the non-dispersive infrared ("NDIR") analyzers.

A test condition (1700 rpm, 372 Nm) was selected for evaluating the eleven different fuels that represents a mid-load, emissions-critical operating point in the transient chassis certification test cycle (FTP75) and lies close to the boundary of the partially premixed charge compression ignition ("PCCI") combustion regime of the engine. It simulates the highway "cruise" operation of a typical pickup truck. Designed statistical experiments were carried out for each of the considered fuels. Several engine control parameters were manipulated for every fuel test: the air-handling system variables included the fresh air-fuel ("AF") ratio and the EGR fraction, whereas the fuel system levers involved the start of the main injection event, the rail pressure, the pilot injection quantity and the separation between the pilot and the main events. The engine was run on a constant-speed mode, and the fueling quantities were held constant by manually adjusting the injector opening durations (also referred to as "ontimes").

The post fueling ontime and the duration between the start of the main- and the post- was kept constant in this study. The total charge flow and the intake manifold pressure were allowed to float.

The engine experiments involved perturbations of the control parameters to achieve an ultra-low NOx combustion process. High EGR rates, elevated rail pressures, and main injection timings centered on top dead center ("TDC"), were employed along with pilot and post events to meet the targeted NOx, smoke and noise emissions. A two-level, full-factorial, central composite approach was selected for the design of the statistical experiment and the corresponding test plan was executed for each fuel using the statistics package MINITAB. Each fuel test involved 90 points representing different levels and combinations of the independent engine control parameters.

In general, six fuels in the mid-to-high cetane range (45-55 approximately) corresponding to the baseline, D, D+, F, I, H tended to run with the same engine control parameter ranges (with respect to air-fuel ratio, EGR rates, pilot quantities, and others). The low cetane number fuels (C and C+) and the ones with low distillation temperatures and flat boiling curves (K and G) needed marginally advanced main injection timings. The engine calibrations and hence the limits used for the various independent variables chosen for the experiments had to be slightly adjusted for some fuels according to their properties in order to achieve NOx and smoke emissions comparable to that of the baseline fuel.

The models for the various engine responses in Equation (1) were formulated such that first function $f_1$ is quadratic in the engine control parameters. In order to avoid over-fitting and oscillatory responses with the use of higher order terms for function $f_2$, a first-order form was used for fuel properties that were least aliased or least correlated as determined previously. Also, to prevent the possible influence of the cetane improver on the functional relationship between fuel properties and NOx, and considering that commercial fuels seldom have such large quantities of the additive, the two cetane improved fuels (C+ and D+) were removed from the regression model and examined separately. The least-squares method was used to fit the models of the form indicated in Equation (1). The models for select engine parameters namely fsNOx, smoke, gisfc, pcp, and CA50 are presented in their normalized forms through FIGS. 2-6. The normalization was done as a fraction of highest value encountered in the experimental range. Good model correlations were achieved for NOx, smoke, pcp, and CA50 (with R-square values of 0.955, 0.908, 0.949, 0.962 respectively) whereas the fit for gisfc (R-square=0.650) exhibited some deviation from the measurements, owing partly to the higher dispersion in the data, and also due to a smaller range of variation in that parameter compared to NOx and smoke. The gisfc predictions were still accurate in view of their percentage standard deviations (taken as the ratio of the standard deviation between correlation and experimental data divided by the mean of the test data) being close to repeatability of the measurement, which was determined to be around 2%.

"Normalized fsNOx observed" is the actual result from the engine test. "Normalized fsNOx calculated" is the result calculated from the mathematical model using the indicated engine operating parameters and fuel properties. Similarly "normalized gisfc observed" is the actual result from the engine test, and "normalized gisfc calculated" is the result calculated from the mathematical model using the indicated engine operating parameters and fuel properties.

Figure 8:
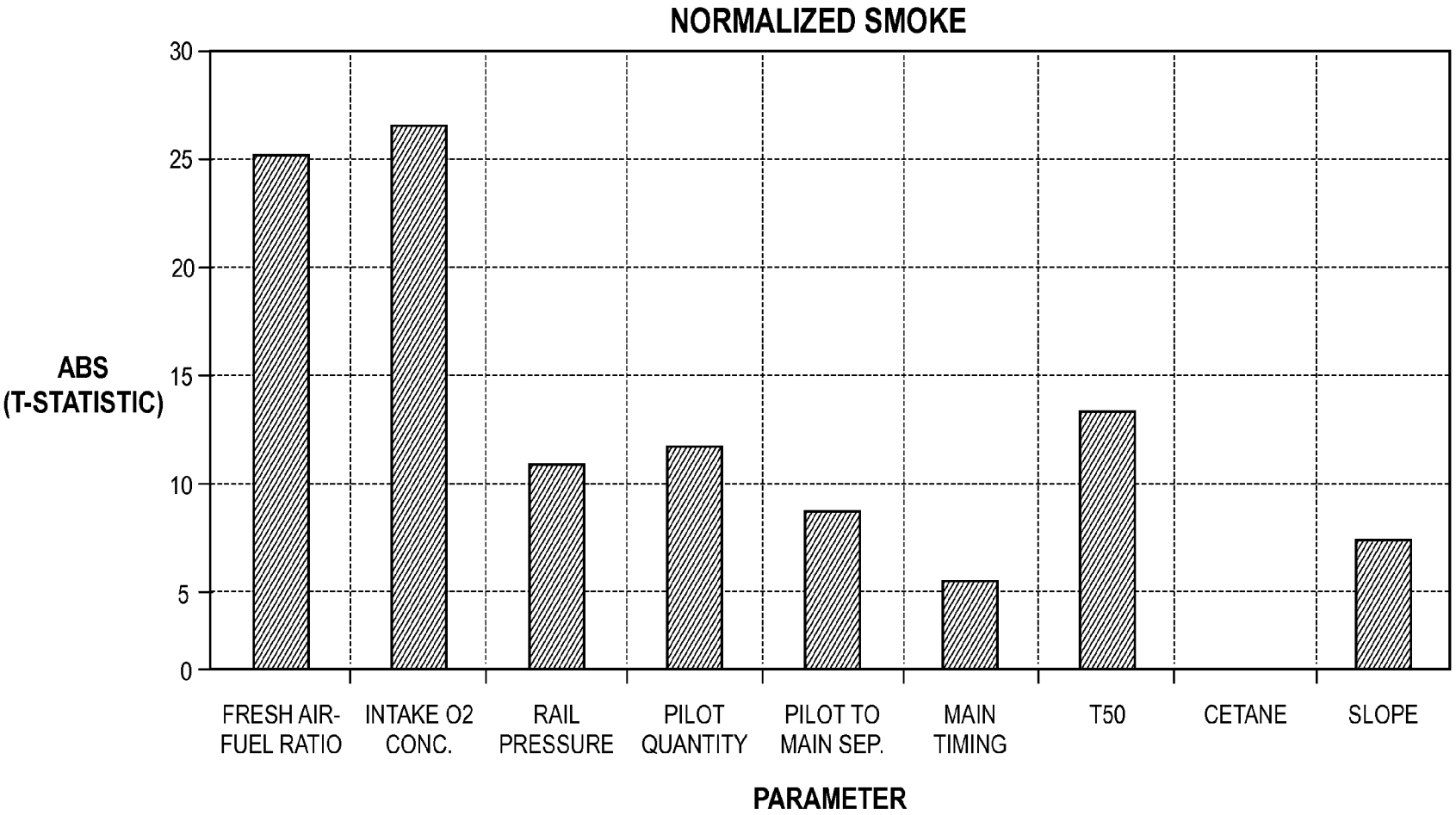
FIG. 8 is a plot of the ratio of the estimated model coefficient to the standard error for each independent engine control and fuel property with regard to its effect on the normalized smoke emission.
Figure 9:
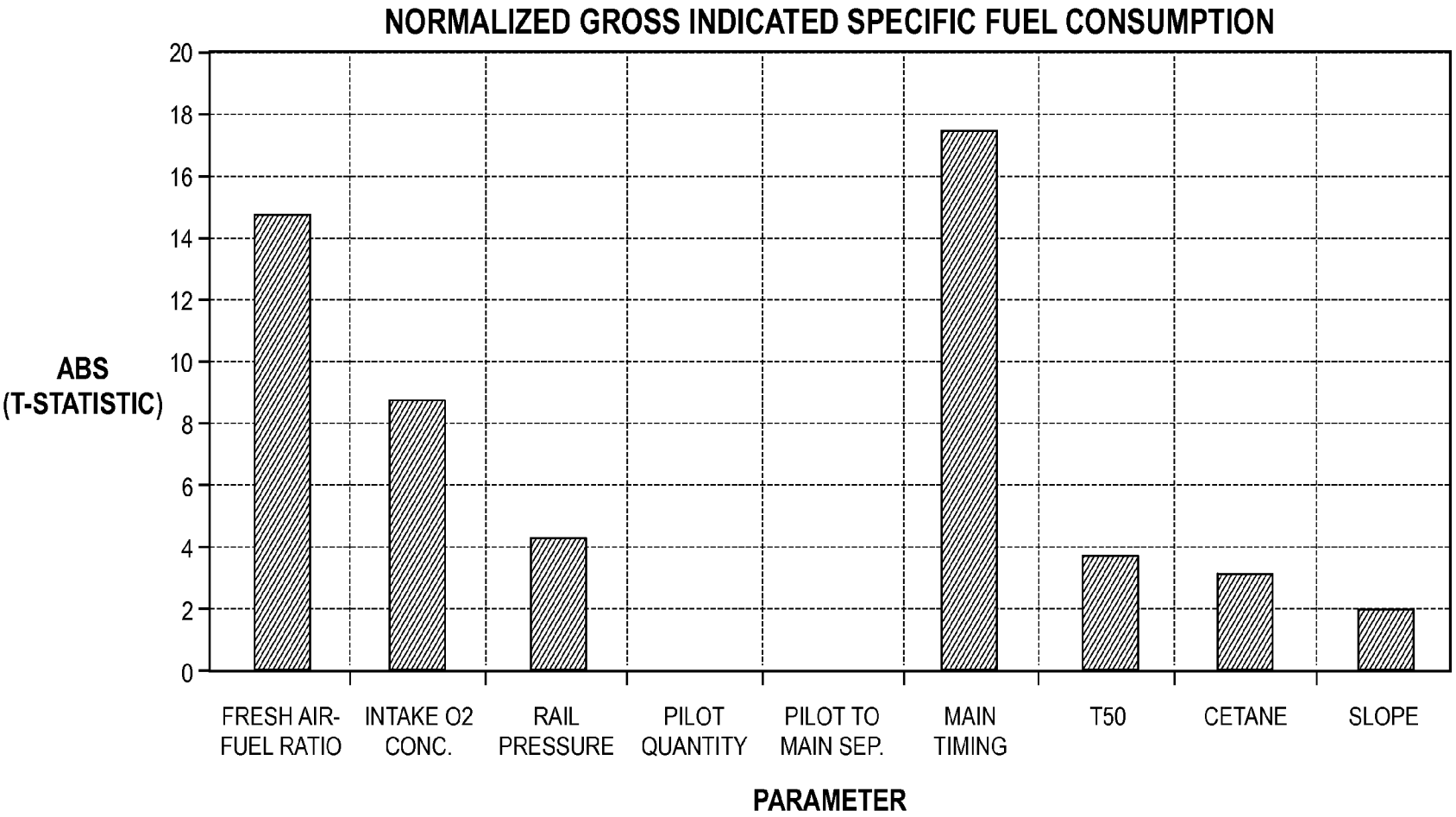
FIG. 9 is a plot of the ratio of the estimated model coefficient to the standard error for each independent engine control and fuel property with regard to its effect on the normalized gross indicated fuel specific consumption.
Figure 10:
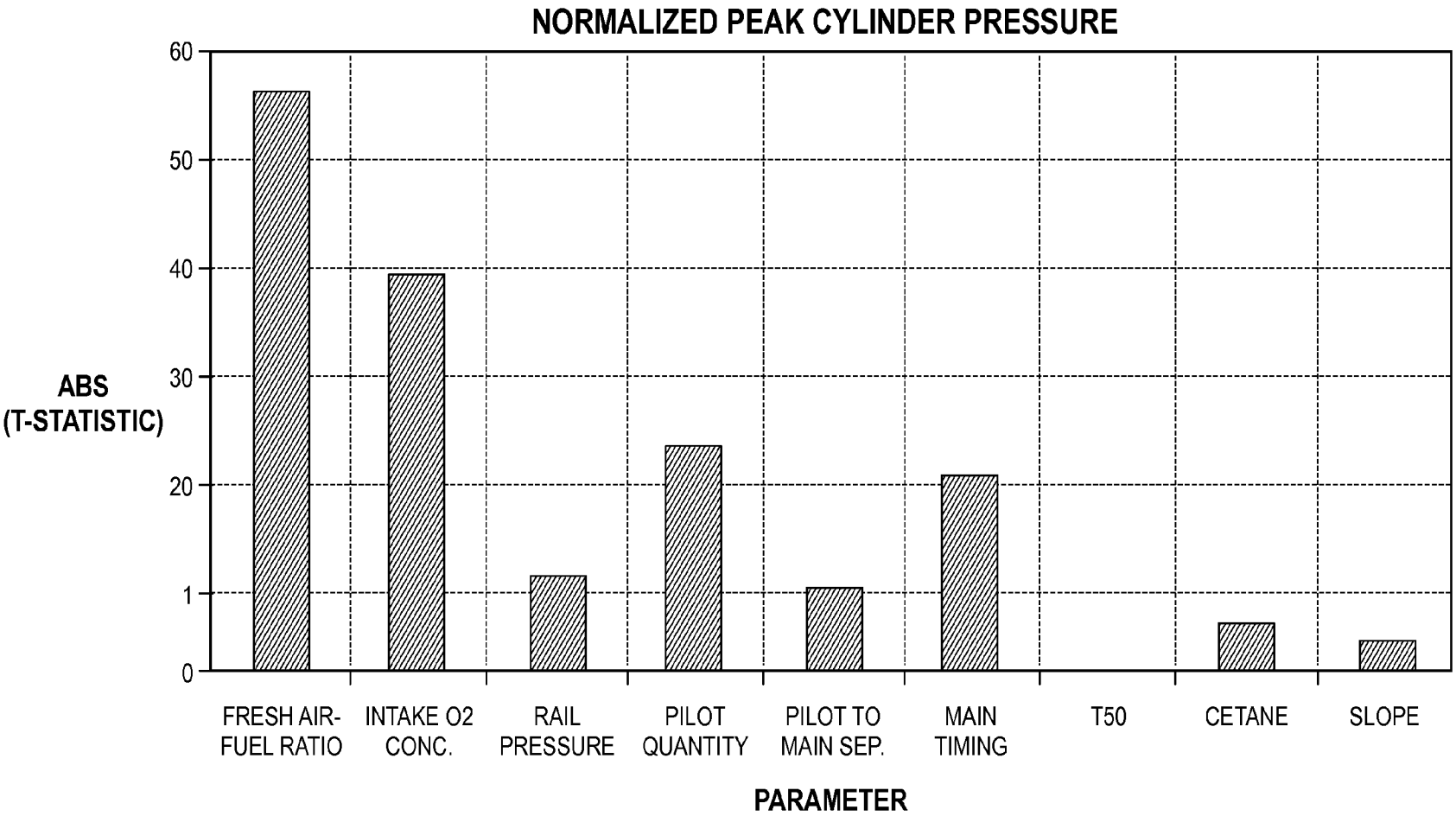
FIG. 10 is a plot of the ratio of the estimated model coefficient to the standard error for each independent engine control and fuel property with regard to its effect on the normalized peak cylinder pressure.
Figure 11:
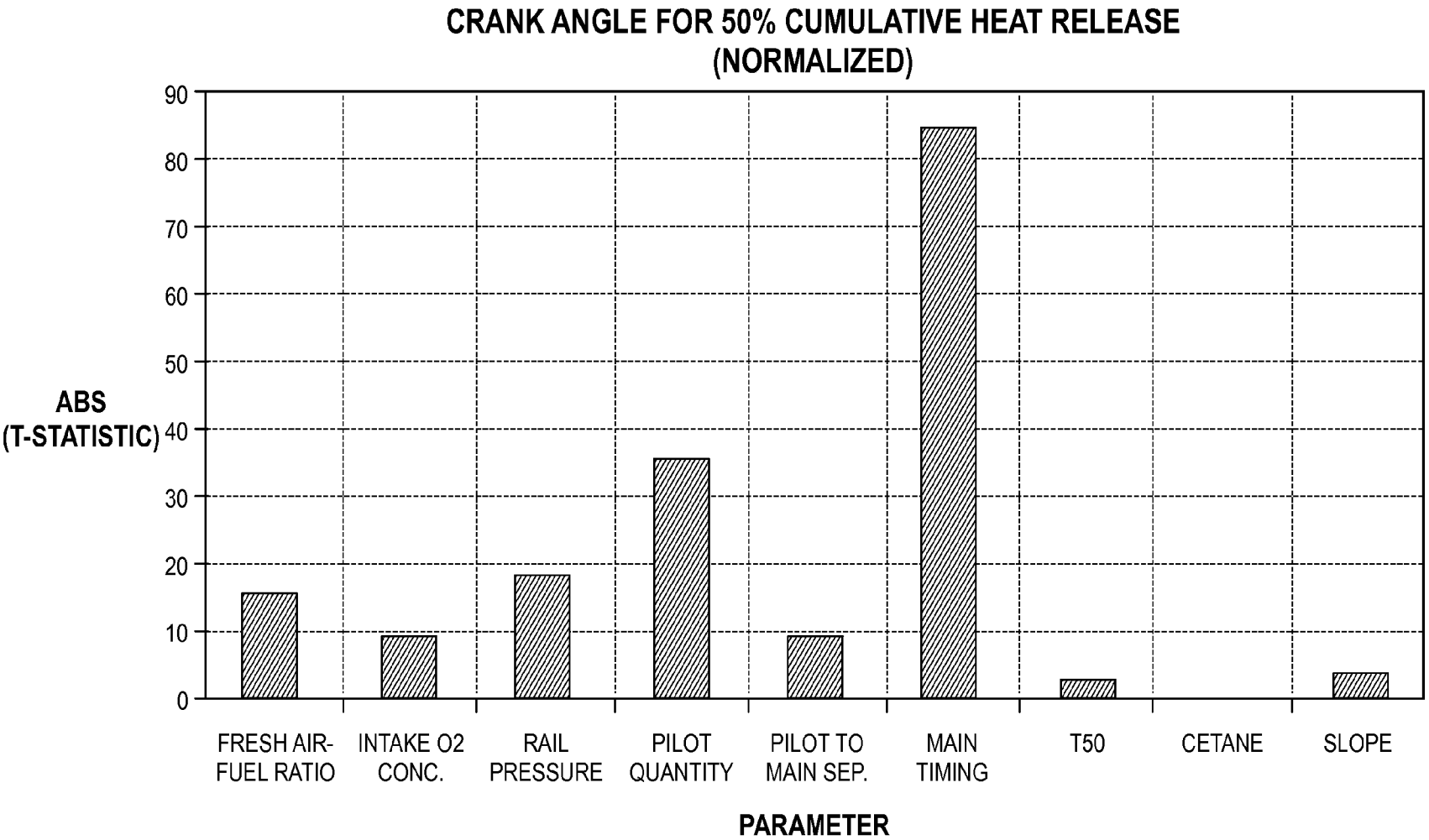
FIG. 11 is a plot of the ratio of the estimated model coefficient to the standard error for each independent engine control and fuel property with regard to its effect on the normalized crank angle for 50 percent cumulative heat release.

In order to identify the parameters exerting the most influence on the engine responses, each model was examined and filtered to include only those terms with a p-value less than 0.05, indicating a 95% confidence on their statistical significance. Further, to isolate the first order terms with the largest effect on NOx, smoke, gisfc, pcp, and CA50, a parameter called t-statistic (defined as the ratio of the estimated model coefficient to the standard error for every term) was computed and inspected for each model. The larger the absolute t-statistic for the term, the more likely the term is significant. FIGS. 7-11 show the absolute t-statistic against their respective engine or fuel parameters for the four responses under consideration. Since EGR control for the engine experiments was achieved through the use of a wide-band intake oxygen sensor, the regression model uses the intake oxygen concentration as a surrogate for EGR. As expected, the strongest dependency for the normalized NOx emission (FIG. 7) is with the intake oxygen concentration: the higher the latter, the lower the diluent mass and hence the greater the NOx. The model captures the well established first-order relationships between engine-out NOx and other control parameters. The fresh air-fuel ratio, rail pressure, EGR, and the pilot quantity, as well as main injection timing all affect NOx to varying degrees. The fuel properties with the most influence on NOx are T50 and to a smaller extent, cetane number. A blank value against the "slope" label indicates its relative insignificance in the NOx model. FIG. 8 shows the first order "significant" terms for smoke: air-fuel ratio and intake $O_2$ concentration relate to smoke emissions primarily through their influence on the composition of the intake charge. Among the fuel properties, T50, and to a smaller degree, the slope, appear to impact smoke. FIG. 9 presents the direct influence of fuel properties on fuel consumption. Furthermore, gisfc is dominated by the influence of engine control parameters over fuel effects. A more advanced main injection timing and higher air-fuel ratio drive improved fuel consumption accompanied with weaker effects for all three fuel properties: T50, cetane number and slope. The two combustion characterization parameters pep and CA50 both appear to be relatively immune to fluctuations in fuel properties (FIGS. 10-11). Engine controls that affect intake manifold pressure (EGR rate and airflow) dominate the pep results whereas main injection timing (CA50) dictates the phasing of the heat release.

The improvement in fuel consumption afforded by the optimum combination of engine controls and the "ideal" fuel properties was determined using the aforesaid models by defining and solving a "minimization" problem. Since the fuel properties selected for the modeling were not correlated, the combination of T50, cetane number and distillation slope that would provide the best fuel consumption would accurately capture the physical fuel attributes required for optimal combustion and emissions for the range and type of fuels evaluated. The optimization of gisfc was conducted with constraints imposed on engine-out emissions such as $NO_x$, smoke, UHC, combustion generated noise, as well as mechanical and structural responses (pcp, and exhaust manifold temperature). Table 4 provides a listing of these constraints against the dependent variables under consideration.

TABLE 4

| DEPENDENT VARIABLES | Constraint (normalized) |
|---|---|
| gisfc | Minimize |
| NO*x* | <0.206 |
| Smoke | <0.266 |
| UHC | <1 |
| Combustion Noise | <0.895 |
| PCP | <0.894 |
| Exhaust temperature | <1 |

The $NO_x$, smoke and UHC constraints were chosen based on legislated emission limits for the FTP75 test, and the combustion noise level was fixed depending on cylinder structural requirements, vehicle drivability and OEM cabinnoise thresholds. Since all fuels exhibited diffusion flame dominated combustion at this operating condition, the engine data indicated that carbon monoxide levels were generally well within the design targets. Suitable ranges were also specified for the independent parameters manipulated as part of the statistical experiments (both engine variables and fuel properties) consistent with the values used for the engine experiments and limited by control states achievable with multi-cylinder engine operation. Table 5 provides a listing of the ranges prescribed for the independent variables considered for the optimization. These ranges would dictate the multi-dimensional "space" allowed for the optimizer algorithm to determine a feasible solution.

TABLE 5

| | Range |
|---|---|
| INDEPENDENT VARIABLES (Engine controls) | |
| Air-fuel ratio | 18-23 |
| Intake $O_2$ fraction | 0.135-0.155 |
| Rail pressure (bar) | 1600-1900 |
| Main injection timing (deg. BTDC) | −2 to 6 |
| Pilot quantity (injector ontime in ms) | 0.15-0.4 |
| Pilot to main separation (ms) | 1-2.25 |
| INDEPENDENT VARIABLES (Fuel properties) | |
| T50 (deg. C.) | 193.3-268.9 |
| Cetane number | 31.8-56.9 |
| Distillation slope (deg. C.) | 57.8-133.9 |

The optimization was performed using a gradient-based algorithm for non-linear multivariable responses by invoking the standard function "fmincon" available in the commercial package MATLAB. This function uses initial starting values for the various independent variables to converge on an optimal solution through numerical iterations. Around 100 random starting points were assigned to the optimizer for multiple runs to ensure that complete design space for the independent variables was swept, and also to determine a "global" optimum instead of the "local" one. Complex response surfaces involving multiple dimensions for the independent variables, and containing linear, square and cross-product terms sometimes produced local inflection points which may not represent the true optimum of the function.

Table 6 provides the results for the optimization conducted to determine the lowest gisfc, presenting the optimal engine control settings and the "ideal" fuel properties. The resultant solution satisfied all the prescribed emissions and mechanical constraints listed in Table 4. The optimal engine calibration calls for a high air-fuel ratio, low intake oxygen concentration, high rail pressure, advanced main injection timing, small pilot quantity and a moderate separation between the pilot and the main events. Clearly, a low intake oxygen concentration is a key enabler for NOx reduction. Higher air-fuel ratios and elevated rail pressures relate to smoke mitigation: the latter typically providing for greater spray penetration, smaller droplet diameters, and faster vaporization. Small pilot quantities aid reductions in combustion noise through early charge-stratification whereas advanced injection timings enhance fuel consumption. The optimal fuel properties represent a low T50, a high cetane number and a moderate distillation slope. Fundamentally, these fuel property values suggest a general preference for a more volatile fuel with enhanced ignition quality and are consistent with the relationships captured in the individual models.

TABLE 6

| | Value |
|---|---|
| INDEPENDENT VARIABLES (Engine controls) | |
| Air-fuel ratio | 22.99 |
| Intake $O_2$ fraction | 0.135 |
| Rail pressure (bar) | 1864 |
| Main injection timing (deg. BTDC) | 5.68 |
| Pilot quantity (injector ontime in ms) | 0.15 |
| Pilot to main separation (ms) | 1.90 |
| INDEPENDENT VARIABLES (Fuel properties) | |
| T50 (deg. C.) | 193.30 |
| Cetane number | 56.90 |
| Distillation slope (deg. C.) | 100.74 |

Figure 12:
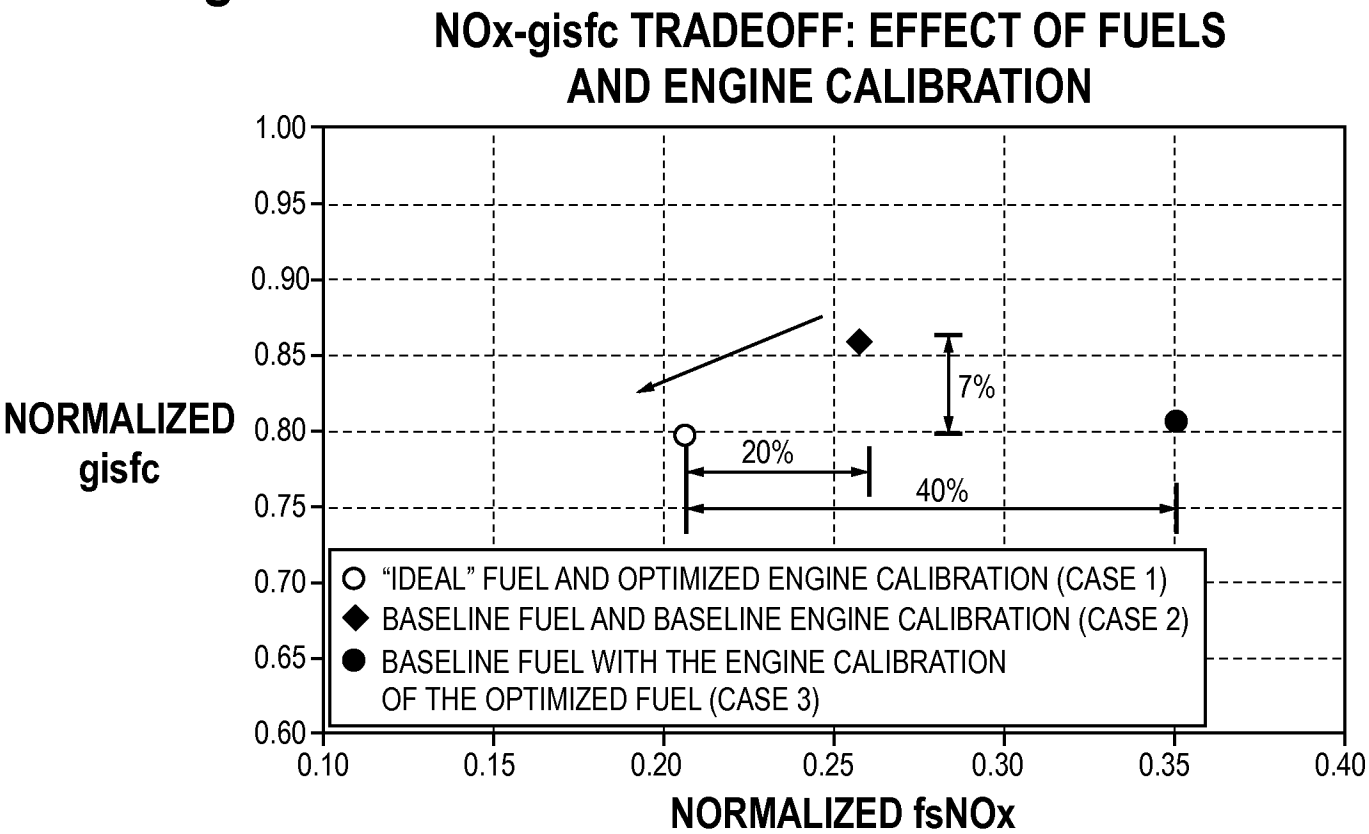
FIG. 12 is a plot of the normalized gisfc versus the normalized fsNOx for two fuels with regard to the effect of fuel properties and engine controls on the NOx-gisfc tradeoff.
Figure 13:
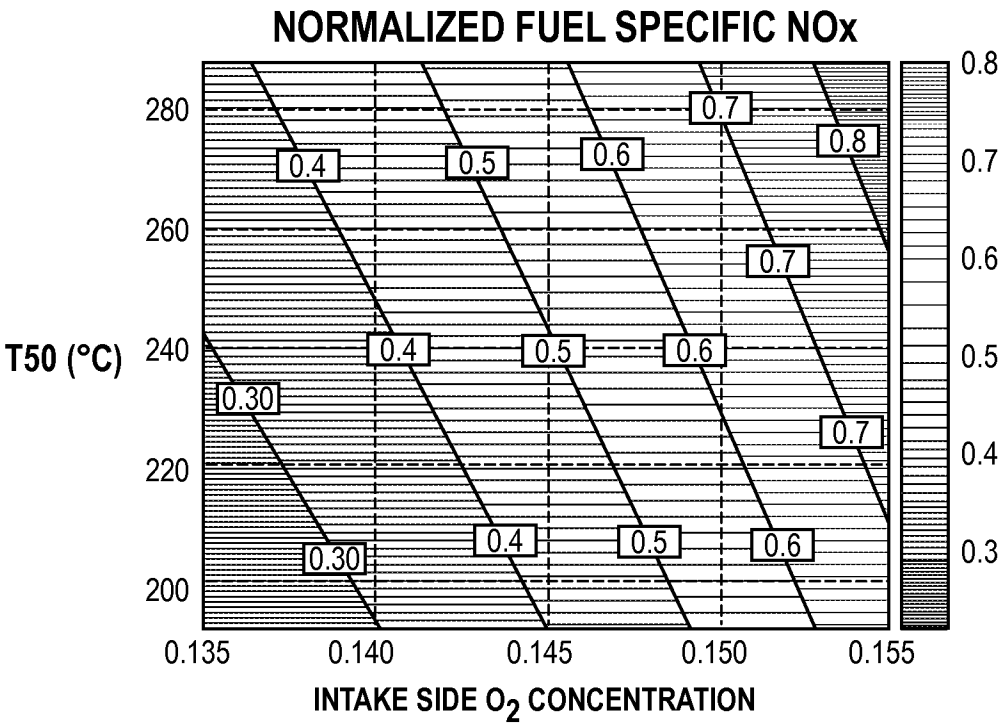
FIG. 13 is a contour plot of the normalized fuel specific NOx emission (on the Z axis) as a function of T50 and intake side oxygen concentration (on the Y and X axes respectively).

To assess the change in engine behavior with the use of the "ideal" fuel versus that of the baseline blend, and to differentiate the effect of fuel properties from engine calibration, two more comparative case runs were conducted. FIG. 12 plots the NOx-gisfc tradeoff (in normalized units) comparing three cases: (1) the lowest gisfc possible with the "ideal" fuel properties in Table 6 and optimal engine control settings in Table 6, (2) the best gisfc at the lowest possible NOx fixing the fuel properties to that of the baseline fuel in Table 1, and (3) the NOx-gisfc combination obtained when the optimum engine calibration in Table 6 for the "ideal" fuel is applied to the fuel properties of the baseline. Table 7 provides a detailed listing of the three different cases showing the engine responses along with the control settings and fuel properties. The information from Table 6 (representing case 1) is repeated in Table 7 and compared to that of cases 2-3.

TABLE 7

| | Optimized fuel and engine calibration (case 1) | Baseline fuel and optimized engine calibration (case 2) | Baseline fuel with engine control settings of case 1 (case 3) | % Reduction (case 3 vs case 1) |
|---|---|---|---|---|
| DEPENDENT VARIABLES Engine (performance parameters) | | | | |
| Normalized NO*x* | 0.206 | 0.257 | 0.351 | 41 |
| Normalized Smoke | 0.256 | 0.265 | 0.313 | 18 |
| Normalized gisfc | 0.795 | 0.856 | 0.807 | 1.5 |

TABLE 7-continued

| | Optimized fuel and engine calibration (case 1) | Baseline fuel and optimized engine calibration (case 2) | Baseline fuel with engine control settings of case 1 (case 3) | % Reduction (case 3 vs case 1) |
|---|---|---|---|---|
| INDEPENDENT VARIABLES (Engine controls) | | | | |
| Air-fuel ratio | 22.99 | 22.94 | 22.99 | |
| Intake $O_2$ fraction | 0.135 | 0.137 | 0.135 | |
| Bail pressure (bar) | 1864 | 1752 | 1864 | |
| Main injection timing (deg BTDC) | 5.68 | −1.26 | 5.68 | |
| Pilot quantity (injector ontime in ms) | 0.15 | 0.15 | 0.15 | |
| Pilot to main separation (ms) | 1.90 | 1.74 | 1.90 | |
| INDEPENDENT VARIABLES (Fuel properties) | | | | |
| T50 (deg. C.) | 193.30 | 255.00 | 255.00 | |
| Cetane number | 56.90 | 44.80 | 44.80 | |
| Distillation slope (deg. C.) | 100.74 | 102.80 | 102.80 | |

Clearly, cases 1 and 2 associate the optimum engine performance and emissions achieved between the "ideal" and the baseline fuels and relative benefits realized using the former. The "optimal" engine settings for the two fuels though, are different. From FIG. 12, the baseline fuel could not be optimized at the same NOx level as that of the "ideal" one. The optimization to determine the best gisfc for the baseline fuel (case 2) was done by progressively relaxing the NOx constraint until a converged solution was achieved. The difference in NOx between the two fuels was around 20% as indicated in the figure, and represents a significant departure in emissions behavior. The gisfc obtained with the baseline fuel was almost 7% higher than that of the "ideal" fuel. The limits on smoke, UHC, combustion noise and mechanical constraints were identical between cases 1-2. The engine control settings between the two cases in Table 7 points to almost identical values for some variables such as air-fuel ratio, intake oxygen, pilot quantity and its separation from the main, but significant deviations in others. Specifically, case 2 makes use of a retarded main injection timing and a slightly lower rail pressure. The difference in the main injection timing explains some of the gisfc deviation between the baseline and the "ideal" fuels. Therefore, the engine could not be optimized to bring the baseline fuel into performance with case 1 to reduce $NO_x$ emissions at minimum fuel consumption.

To separate out the effect of fuel properties versus the impact of its engine control settings (main injection timing and rail pressure, primarily), case 3 was run by fixing the appropriate lever positions in the respective models for $NO_x$, smoke and gisfc to those of case 1 (or "ideal" fuel). The advanced timing and a marginal increase in rail pressure for case 3 bring the fuel consumption within about 1% nearer to that of the "ideal" fuel in case 1, but the baseline fuel causes a significant increase in the $NO_x$ emissions and a slight rise in the smoke as indicated in Table 7. These results indicate a significant enhancement in the $NO_x$-gisfc tradeoff through the use of an "ideal" fuel blend. Therefore, comparing case 3 with case 1, where the engine control settings are constant, illustrates a reduction in $NO_x$ emissions of 41% and a reduction in smoke emissions of 18% when using the "ideal" fuel. The $NO_x$ benefit in-turn, can be leveraged (with further optimization) to slightly increase the EGR rate and advance the main injection timing to enhance fuel efficiency. At a "cruise" operating condition such as the one chosen here to run the engine experiments, these fuel consumption enhancements represent a substantial improvement to the fuel tank mileage.

Figure 14:
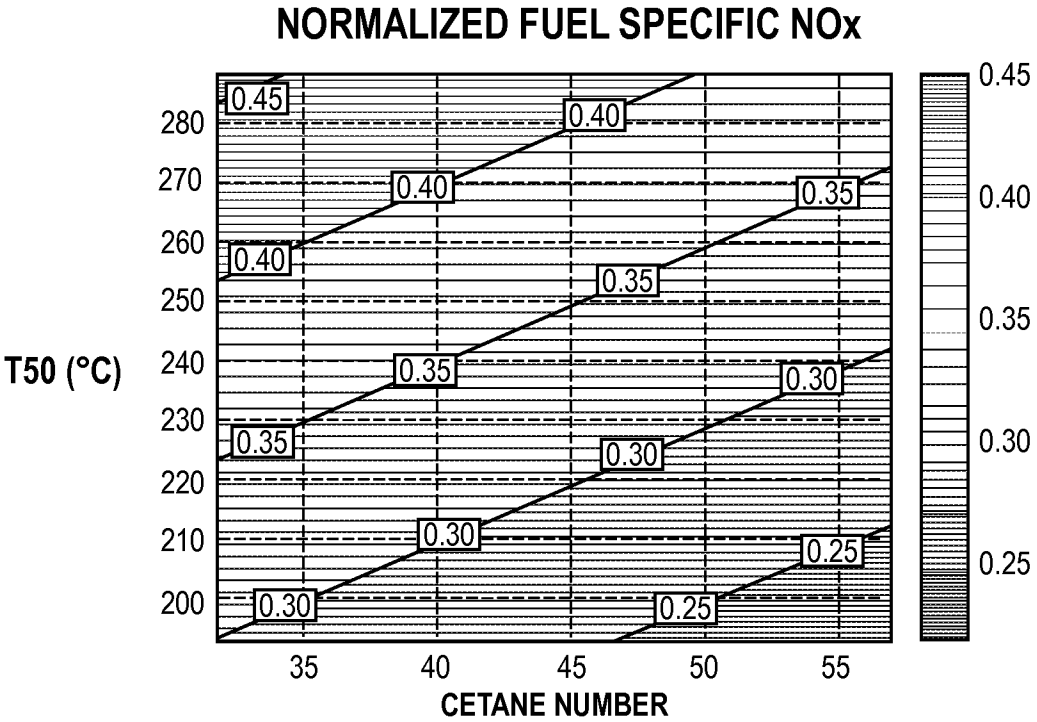
FIG. 14 is a contour plot of the normalized fuel specific NOx emission (on the Z axis) as a function of T50 and cetane number (on the Y and X axes, respectively).

The models were also used to analyze trends relating engine behavior to fuel properties and engine control levers. FIGS. 13-17 provide contour plots for the normalized forms of NOx, smoke and gisfc as a function of select variables or first-order model terms identified to have the strongest effect on each of them as identified in FIGS. 7-9, respectively. The model parameters which are not a part of the x- or the y-axes have been fixed at the optimal settings for the "ideal" fuel provided in Table 6. A contour plot of $NO_x$ as a function of intake oxygen concentration and T50 (FIG. 13) confirms the well established and strong relationship between $NO_x$ and EGR. A lower T50 causes $NO_x$ to go down, though not as sharply as with EGR. FIG. 14 shows the variation of $NO_x$ as a function of cetane number and T50. A combination of lowering T50 and increasing cetane number appears to provide a significant reduction moving from the top left hand corner of the plot (high T50 and low cetane) to the bottom right hand region. In general, the effect of T50 appears to be stronger than that of cetane.

Figure 15:
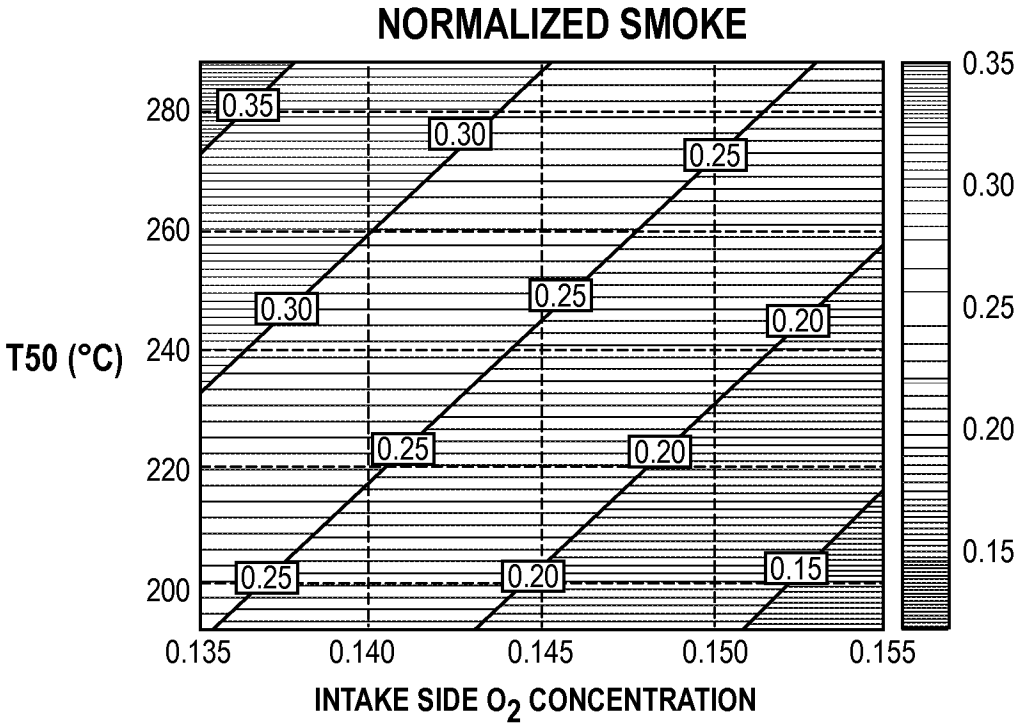
FIG. 15 is a contour plot of the normalized smoke (on the Z axis) as a function of T50 and intake side oxygen concentration (on the Y and X axes, respectively).
Figure 16:
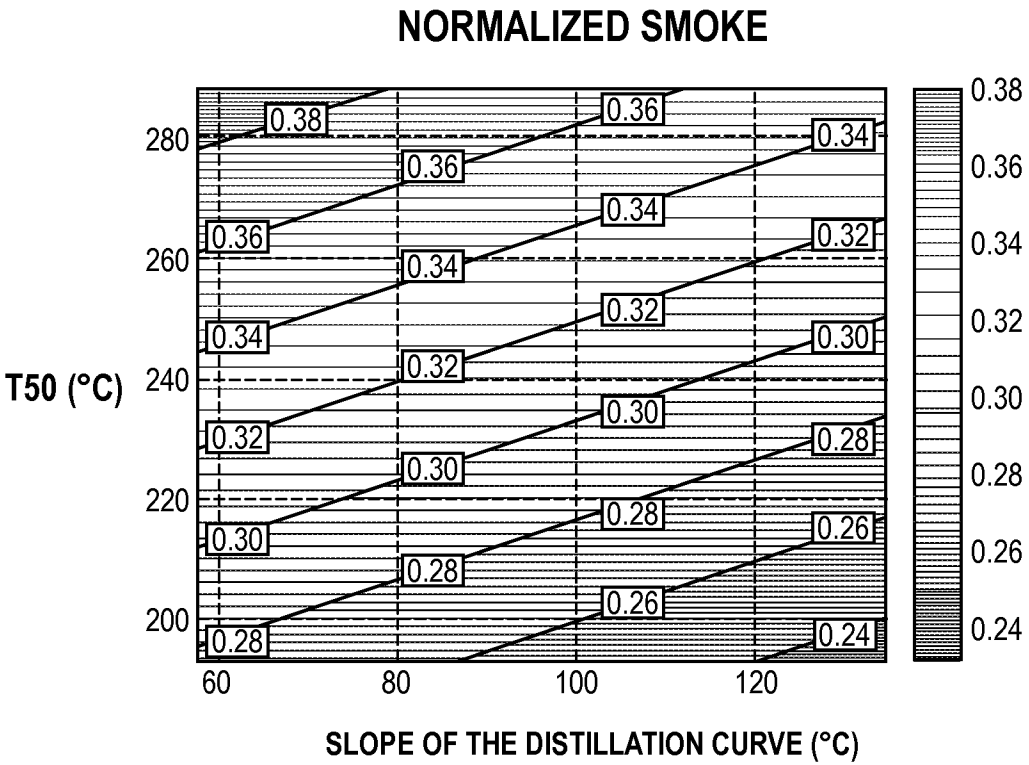
FIG. 16 is a contour plot of the normalized smoke (on the Z axis) as a function of T50 and slope of the distillation curve (on the Y and X axes, respectively).

FIG. 15 represents the variation of smoke as a function of intake oxygen concentration and T50. Similar to the trend in $NO_x$, a reduction in T50 results in a smoke reduction. The influence of EGR is opposite to that for $NO_x$: higher intake oxygen fractions (and hence lower EGR rates) contribute to lower smoke emissions and is attributed to enhanced oxygen availability for the soot combustion. FIG. 16 illustrates that the distillation slope of the fuel appears to have a minor effect on smoke emission. Steeper boiling curves provide a smoke benefit which is much weaker than the benefit provided by decreasing values of T50.

Figure 17:
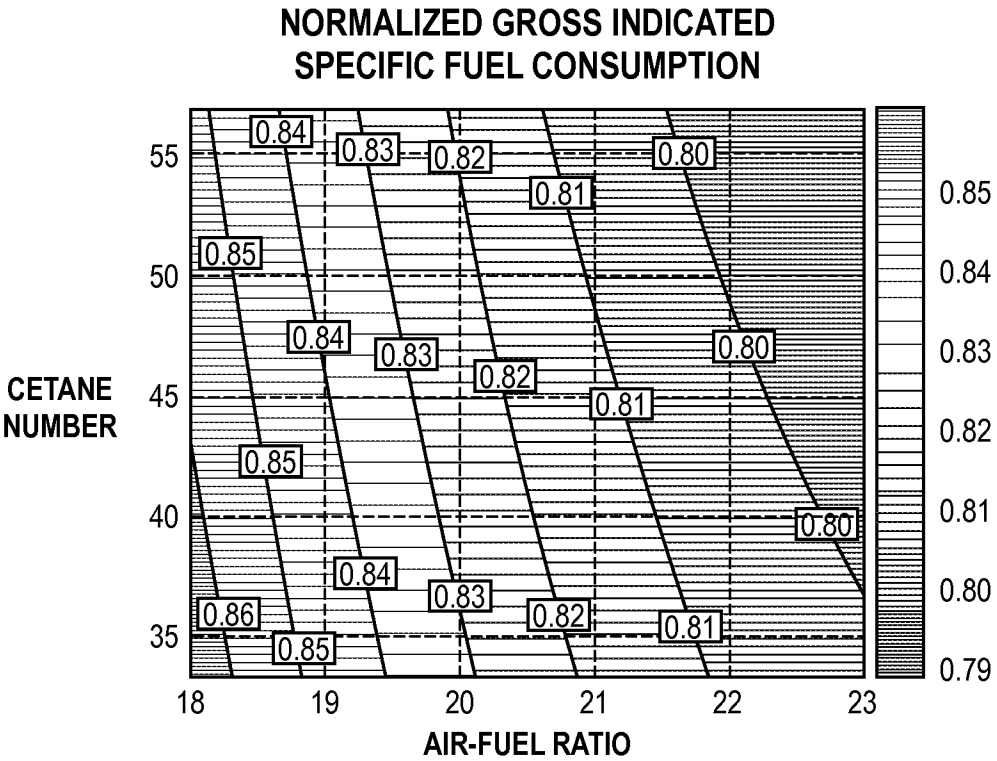
FIG. 17 is a contour plot of the normalized gross indicated specific fuel consumption (on the Z axis) as a function of cetane number and air-fuel ratio (on the Y and X axes, respectively).

FIG. 9 illustrates that the regression model for gisfc is dominated by the engine control variables over the fuel properties. Cetane number and, to a smaller extent, the distillation slope are identified as the significant first order terms in the gisfc model. FIG. 17 shows the variation of gisfc as a function of air-fuel ratio and cetane number. A change in air-fuel ratio spanning 18-23 causes gisfc to go down by nearly 6.5% moving from the left to the right of the plot. A change in cetane level going up from 31.8 to 56.9, corresponding to the extreme levels chosen for the fuels design, shows only a small direct benefit (around 1%) on gisfc.

To confirm the effect of fuel properties and their relations to engine-out emissions, a comparison was done between select data points from two fuels differing significantly only in cetane or T50 characteristics, and having close engine operating parameters between them. Table 8 compares fuels H and D, with almost identical cetane values, but differing appreciably in their T50. From the table and the regression models, a reduction in T50 (going from fuel D to fuel H) causes both NOx and smoke emissions to decrease by 27% and 21%, respectively. The emissions reductions obtained by comparing fuel H and D are indicative of the effect of T50.

TABLE 8

| Fuel label | D | H | % Reduction |
|---|---|---|---|
| T50 (° C.) | 215.6 | 288.3 | |
| Cetane number | 46 | 44.4 | |
| Slope (° C.) | 73.9 | 103.9 | |
| Engine-out $NO_x$ (normalized) | 0.41 | 0.56 | 27 |
| Engine-out smoke (normalized) | 0.22 | 0.28 | 21 |

Similarly, Table 9 compares two fuels with identical T50 and slope, but significantly different cetane number. The drop in NOx by 10% with a higher cetane fuel is consistent with the model results presented in FIGS. 7 and 13. The $NO_x$ emissions reduction of 10% compared to the baseline is the effect of fuel F' s higher cetane number. It should be noted that the engine control settings were the same for both fuels, although they were not the optimized engine settings. Hence, the engine-out $NO_x$ is not comparable to Table 7 values.

TABLE 9

| Fuel Label | F | Baseline | % Reduction |
|---|---|---|---|
| T50 (° C.) | 253.9 | 255.0 | |
| Cetane number | 56.9 | 44.8 | |
| Slope | 104.4 | 102.8 | |
| Engine-out NO*x* (normalized) | 0.17 | 0.19 | 10 |

Thus, the influence of various diesel fuel properties on the steady state emissions and performance of a Cummins light-duty (ISB) engine modified for single cylinder operation at the mid-load "cruise" operating condition has been determined. Designed experiments involving independent manipulation of both fuel properties and engine control parameters have been used to build statistical engine response models, which have then been applied to optimize for the minimum fuel consumption subject to specific constraints on emissions and mechanical limits and also to estimate the optimum engine control parameter settings and fuel properties. Under the high EGR, diffusion-burn dominated conditions encountered during the experiments, NOx is impacted by the cetane and distillation characteristics. A lower T50 (mid-distillation temperature) results in simultaneous reductions in both NOx and smoke, and a higher cetane number provides an additional small NOx benefit. The optimum fuel properties appeared to provide a better NOx-fuel consumption tradeoff than that achieved by a representative No. 2 ULSD.

The effect of a nitrogen-containing cetane improver, in this case, 2-ethyl hexyl nitrate ("EHN") on normalized fxNOx and normalized gisfc is illustrated in Table 10 for Fuels C and D, which do not contain a cetane improver, and Fuels C+ and D+ which contain EHN. The values of normalized fxNOx calculated were determined using the Normalized fsNOx model described hereinabove and are presented in Table 10. The values of normalized fxNOx observed and of normalized gisfc observed were measured in the engine tests. Comparable engine settings were employed to obtain the results shown in Table 10.

TABLE 10

| | Fuel C | Fuel C+ | Fuel D | Fuel D+ |
|---|---|---|---|---|
| Normalized fs NO*x* observed | 0.49 | 0.55 | 0.40 | 0.58 |
| Normalized fs NO*x* calculated | 0.49 | 0.41 | 0.39 | 0.37 |
| Normalized gisfc observed | 0.842 | 0.852 | 0.862 | 0.834 |
| EHN, ppm | 0 | 5000 | 0 | 3200 |
| Engine operating settings | | | | |
| Air-fuel ratio | 20.18 | 20.29 | 22.39 | 22.37 |
| Intake O2 fraction | 0.1430 | 0.1444 | 0.1441 | 0.1440 |
| Rail pressure (bar) | 1800 | 1900 | 1900 | 1899 |
| Main injection timing (deg BTDC) | 6.0 | 6.0 | 4.0 | 4.0 |
| Pilot quantity (injector ontime in ms) | 0.35 | 0.35 | 0.35 | 0.35 |
| Pilot to main separation (ms) | 1.00 | 1.00 | 2.25 | 2.25 |

The values of normalized fsNOx calculated for Fuels C+ and D+ are lower than for Fuels C and D, respectively, because Fuels C+ and D+ have higher cetane numbers than do Fuels C and D, respectively. This is consistent with the cetane number effect shown in Table 9. However, the normalized fsNOx observed for Fuels C+ and D+ are higher than for Fuels C and D, respectively, because EHN contains nitrogen.

The value of normalized gisfc observed for Fuel D+ is lower than (i.e., improved over) that for Fuel D because increasing the cetane number improves (i.e., reduces) normalized gisfc observed, as shown in FIG. 17. However, the value of normalized gisfc observed for Fuel C+ is higher than that for Fuel C because the operating setting for intake oxygen fraction is significantly higher when Fuel C+ was tested, and the intake oxygen fraction engine variable has a strong influence on normalized gisfc observed, as shown in FIG. 9.

The impact of replacing the nitrogen-containing cetane improver (EHN) with a nitrogen-free cetane improver (di-tert-butyl peroxide ("DTBP")) is illustrated below in Table 11. A General Motors 1.9 liter four cylinder engine operated at 2000 rpm and 5.5 bar indicated mean effective pressure (approximately 130 Nm), a constant intake O2 fraction of 0.095, and various start of fuel injection command timings was employed to evaluate the eleven fuel blends whose physical and chemical properties, along with respective ASTM methods, were used for their measurements.

TABLE 11

| Fuel ASTM method | T10, ° C. D86 | T50, ° C. D86 | T90, ° C. D86 | Cetane Number D613 | Cetane Improver ppm | Mono-aromatics wt % D5186 | Poly aromatics wt % D5186 | Total aromatics D5186 | Gross Heating value Mi/kg D4809 |
|---|---|---|---|---|---|---|---|---|---|
| Baseline | 209.3 | 253.1 | 295.1 | 42.5 | 0 | 20.6 | 7.3 | 27.9 | 45.8 |
| AX | 202.2 | 237.8 | 296.7 | 42.9 | 0 | 26.2 | 7.8 | 34.0 | 45.5 |
| BB | 204.3 | 250.6 | 316.9 | 52.2 | 0 | 19.3 | 3.6 | 22.9 | 46.0 |
| CC | 190.4 | 213.4 | 246.6 | 45 | 0 | 19.2 | 1.0 | 20.2 | 46.2 |
| EE | 222.8 | 270.3 | 323.8 | 58.9 | 0 | 15.0 | 2.8 | 17.8 | 45.9 |
| FF | 222.7 | 262.4 | 317.4 | 35.3 | 0 | 24.3 | 29.5 | 53.8 | 44.1 |
| HH | 217.9 | 250.8 | 285.6 | 38.3 | 0 | 22.6 | 2.6 | 25.2 | 46.0 |
| LL | 209.3 | 258.6 | 321.1 | 45 | 0 | 20.4 | 20.3 | 40.7 | 44.7 |
| CC++ | 190.4 | 213.4 | 246.6 | 51.9 | 3500 EHN | 19.2 | 1.0 | 20.2 | 46.2 |
| LL++ | 209.3 | 258.6 | 321.1 | 51.7 | 3500 EHN | 20.4 | 20.3 | 40.7 | 45.2 |
| LL## | 209.3 | 258.6 | 321.1 | 51.60 | 6800 DTBP | 19.9 | 20.5 | 40.4 | 44.2 |

Figure 18:
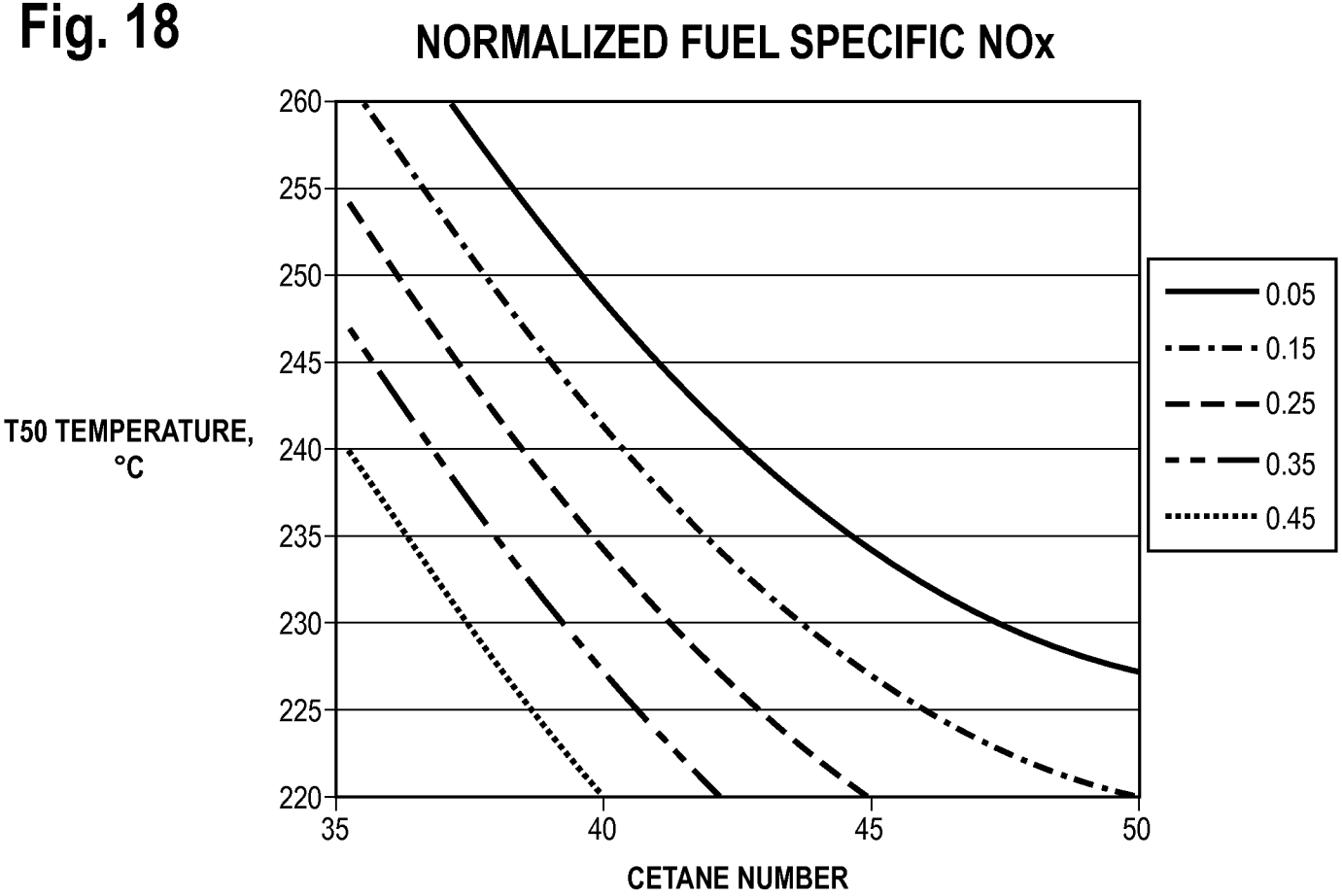
FIG. 18 is contour plot of normalized fuel specific NOx emissions (on the Z axis) as a function of T50 and cetane number (on the Y and X axes, respectively).
Figure 19:
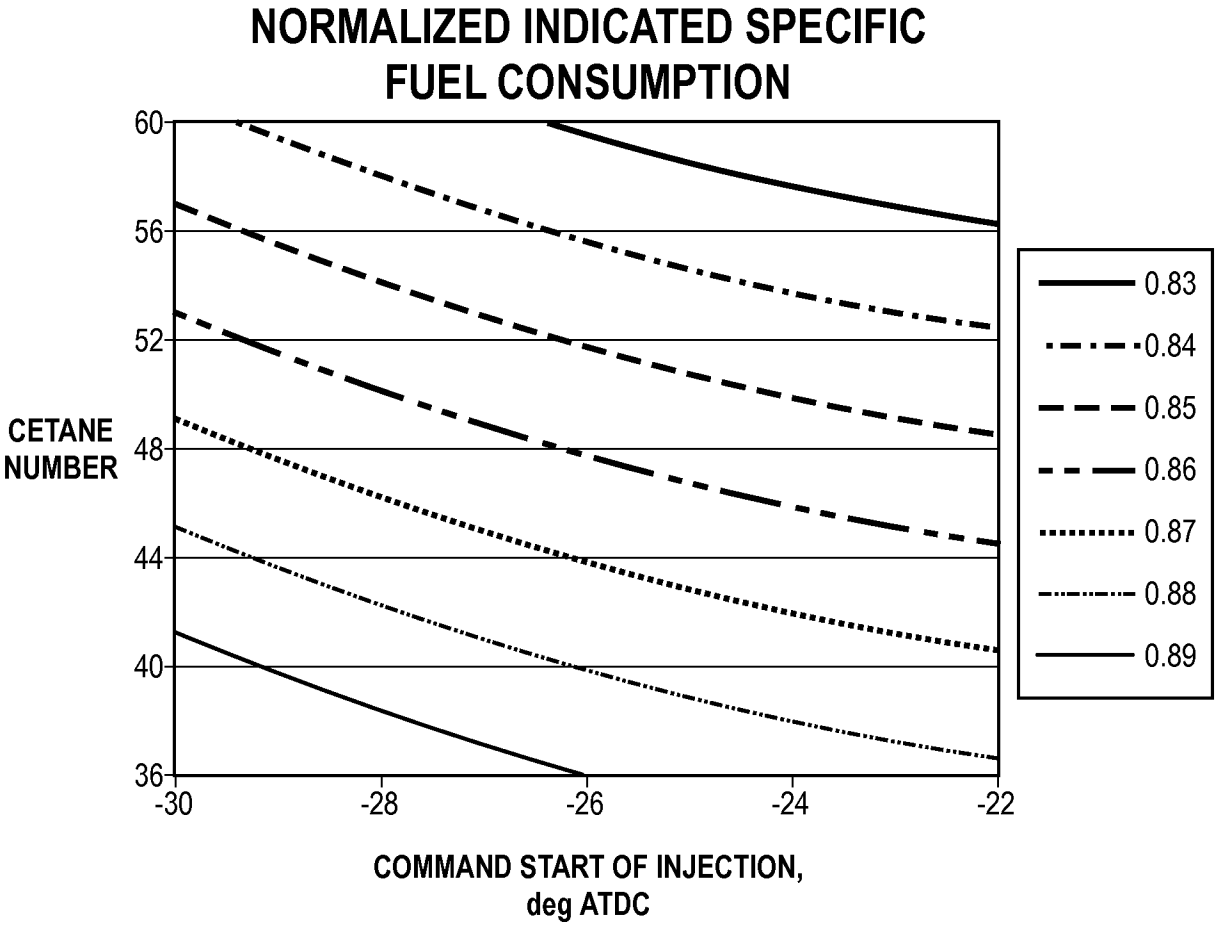
FIG. 19 is a contour plot of the normalized specific fuel consumption (on the Z axis) as a function of the cetane number and command start of injection (on the Y and X axes, respectively).

Regression models for normalized fsNOx emissions and normalized gisfc were developed using the engine command start of injection function for both observed results. For the normalized fsNOx model, the cetane number and distillation curve slope were used as linear functions and T50 was used as a quadratic function to describe the data. As described hereinabove for Fuels C+ and D+, Fuels CC++, LL++ and LL## which contain cetane improvers were not included for the normalized NOx model. For the normalized gisfc model, cetane number, T50 and distillation curve slope were used as linear functions to describe the data. The contour plots in FIGS. 18 and 19 illustrate the influence of the fuel properties and engine variables on normalized fsNOx and normalized gisfc, respectively.

Using the same procedure as described in the discussion hereinabove relating to Tables 4-7, optimum engine operating conditions and fuel parameters that would serve to minimize normalized gisfc calculated and simultaneously keep normalized fsNOx calculated low were determined from the aforesaid models. The constraint for normalized fsNOx calculated was selected as 0.08 because of the lower power operation of the engine. Since normalized fsNOx calculated increases as engine power increases, the constraint of 0.08 for normalized fsNOx calculated is also expected to afford acceptable performance at higher engine output.

The data in Table 12 illustrate the results of this optimization. The Cases A, B and C shown in Table 12 correspond to Cases 1, 2 and 3 respectively, in Table 7. Thus, Case A represents the lowest gisfc possible with the "ideal" fuel properties and optimal engine control settings. Case B represents the best gisfc at the lowest possible fsNOx fixing the fuel properties to those of the baseline fuel in Table 11. Case C represents the fsNOx-gisfc combination obtained when the optimum engine calibration for the "ideal" fuel is applied to the fuel properties of the baseline fuel. The engine responses along with the control settings and fuel properties are presented in Table 12. The results from the General Motors engine in Table 12 are in accord with the Cummins engine in Table 7 in that the normalized NOx and the normalized gisfc are reduced by the use of the optimum fuel at the optimum engine control settings compared to the baseline fuel at the same engine control settings.

TABLE 12

| | Optimized fuel and engine calibration (case A) | Baseline fuel and optimized engine calibration (case B) | Baseline fuel with engine control settings of case A (case C) | % Reduction case C vs case A |
|---|---|---|---|---|
| DEPENDENT VARIABLES (Engine performance parameters) | | | | |
| Normalized NOx | 0.08 | 0.076 | 0.1896 | 58 |
| Normalized gisfc | 0.82 | 0.9517 | 0.8728 | 6.0 |
| INDEPENDENT VARIABLES (Engine controls) | | | | |
| Command starts of inject ATDC | −21 | −40 | −21 | |
| INDEPENDENT VARIABLES (Fuel properties) | | | | |
| T50 (deg. C.) | 230.2 | 253.1 | 253.1 | |
| Cetane number | 58.9 | 42.5 | 42.5 | |
| Distillation slope (deg. C.) | 56.2 | 85.7 | 85.7 | |

The values of normalized fsNOx calculated, normalized fsNOx observed, normalized gisfc calculated, and normalized gisfc observed for Fuels CC, CC++, LL, LL++ and LL## are presented in Table 13 at a constant engine setting. The choice of fsNOx normalization constant for the series of fuels CC and CC++ was different than the fsNOx normalization constant for series of fuels LL, LL++, LL## to facilitate comparisons within each series. However the choice for the gisfc normalization constant was the same for all fuels to facilitate comparisons among all the fuels.

TABLE 13

| | Fuel CC | Fuel CC++ | % NOx increase | Fuel LL | Fuel LL++ | % NOx increase | Fuel LL## | % NOx reduction |
|---|---|---|---|---|---|---|---|---|
| Normalized fsNOx, observed | 0.35 | 0.95 | 170 | 0.5 | 0.99 | 98 | 0.4 | 60 |
| Normalized fsNOx, calculated | 0.35 | 0.24 | | 0.48 | 0.38 | | 0.38 | |
| Normalized gisfc, observed | 0.881 | 0.853 | | 0.88 | 0.87 | | 0.87 | |
| Normalized gisfc, calculated | 0.870 | 0.852 | | 0.885 | 0.869 | | 0.869 | |
| Engine setting | | | | | | | | |
| Command start of injection (deg ATDC) | −27 | −27 | | −27 | −27 | | −27 | |

The results in Table 13 confirm the results in Table 10. A comparison of the results for fuels CC and LL with those for fuels CC++, LL++ and LL##, respectively, demonstrates that increasing the cetane number reduces gisfc. The results also demonstrate that the use of the nitrogen-containing cetane improver, EHN, increases $NO_x$, by more than 90%. These results are surprising given the fact that it is generally recognized by those skilled in the art that EHN does not increase NOx emissions during normal compression ignition engine operation (i.e., high temperature). See, e.g., Schwab, S. D.; Guinther, G. H.; Henly, T. J.; and Miller, K. T.; "The Effects of 2-Ethylhexyl Nitrate and Di-tertiary-butyl Peroxide on the Exhaust Emissions from a Heavy Duty Diesel Engine" SAE Paper No. 1999-01-1478, International Spring Fuels and Lubricants Meeting and Exposition, Dearborn, Mich., May 1999.

However the use of a nitrogen-free cetane improver in fuel LL## results in a reduction of $NO_x$ by 60% compared to the fuel LL++ that has the same cetane number and other fuel properties. Therefore, this example shows the advantage of using a nitrogen-free cetane improver in that low fuel consumption obtained by using high cetane fuel can be maintained without increasing NOx emissions. Furthermore, a comparison of fuel LL## with the lower cetane fuel LL shows a NOx reduction of 20%, even though engine conditions were not optimized.

While the present invention is described above in connection with preferred or illustrative embodiments, these embodiments are not intended to be exhaustive or limiting of the invention. Rather, the invention is intended to cover all alternatives, modifications and equivalents included within its spirit and scope, as defined by the appended claims

What is claimed is:

1. A method for reducing NOx emissions from a diesel engine at minimum fuel consumption wherein the diesel engine operates in a low temperature combustion mode, comprising the step of adding to the diesel engine at least one diesel fuel having a combination of a low T50 in the range of from 190° C. to 280° C., a high cetane number in the range of from 31 to 60, and an effective emissions reducing amount of a nitrogen-free cetane improver.

2. The method of claim 1 wherein the diesel fuel has a low T50 in the range of from 190° C. to 255° C.

3. The method of claim 1 wherein the diesel fuel or has a high cetane number in the range of from 40 to 60.

4. The method of claim 1 wherein the diesel fuel or additionally has a high distillation curve slope in the range of from 58° C. to 140° C.

5. The method of claim 4 wherein the diesel fuel or has a high distillation curve slope in the range of from 80° C. to 140° C.

6. The method of claim 1 wherein the diesel fuel has a nitrogen-free cetane improver selected from the group consisting of alkyl peroxides, aryl peroxides, alky aryl peroxides, acyl peroxides, peroxy esters, peroxy ketones, per acids, hydroperoxides, and mixtures thereof.

7. The method of claim 6 wherein the nitrogen-free cetane improver is di-tert-butyl peroxide.

8. The method of claim 1 wherein the amount of the nitrogen-free cetane improver is in the range of from about 10 ppm to about 10,000 ppm.

9. The method of claim 1 wherein the amount of the nitrogen-free cetane improver is in the range of from about 100 ppm to about 10,000 ppm.

10. The method of claim 1 wherein the NOx emissions from the diesel engine are reduced by at least 10%.

11. A diesel fuel composition for reducing NOx emissions from a diesel engine at minimum fuel consumption wherein the diesel engine operates in a low temperature combustion mode, comprising at least one diesel fuel having a combination of a low T50 in the range of from 190° C. to 280° C., a high cetane number in the range of from 31 to 60, and an effective emissions reducing amount of a nitrogen-free cetane improver selected from the group consisting of aryl peroxides, alky aryl peroxides, acyl peroxides, proxy esters, peroxy ketones, per acids, hydroperoxides, and mixtures thereof.

12. The composition of claim 11 wherein the diesel fuel has a low T50 in the range of from 190° C. to 255° C.

13. The composition of claim 11 wherein the diesel fuel has a high cetane number in the range of from 40 to 60.

14. The composition of claim 11 wherein the diesel fuel additionally has a high distillation curve slope in the range of from 58° C. to 140° C.

15. The composition of claim 14 wherein the diesel fuel has a high distillation curve slope in the range of from 80° C. to 140° C.

16. The composition of claim 11 wherein the amount of the nitrogen-free cetane improver is in the range of from about 10 ppm to about 10,000 ppm.

17. The composition of claim 11 wherein the amount of the nitrogen-free cetane improver is in the range of from about 100 ppm to about 10,000 ppm.

18. The composition of claim 11 wherein the NOx emissions from the diesel engine are reduced by at least 10%.

19. The method of claim 1 wherein the diesel fuel is selected from the group consisting of fuels blended from intermediate refinery blend streams and combinations of finished distillate fuels.

20. The composition of claim 11 wherein the diesel fuel is selected from the group consisting of fuels blended from intermediate refinery blend streams and combinations of finished distillate fuels.

* * * * *